US012479689B2

(12) United States Patent
Fratianni et al.

(10) Patent No.: US 12,479,689 B2
(45) **Date of Patent: *Nov. 25, 2025**

(54) SLIDING LOCK FOR BREAK-DOWN SPOOL

(71) Applicant: Sonoco Development, Inc., Hartsville, SC (US)

(72) Inventors: Edmond L. Fratianni, Old Chatham, NY (US); Fedor Baranov, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 205 days.

This patent is subject to a terminal disclaimer.

(21) Appl. No.: 18/200,704

(22) Filed: May 23, 2023

(65) Prior Publication Data

US 2023/0286776 A1 Sep. 14, 2023

Related U.S. Application Data

(63) Continuation of application No. 17/190,136, filed on Mar. 2, 2021, now Pat. No. 11,697,569.

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01); *B65H 75/2245* (2021.05); *B65H 75/2263* (2021.05); *B65H 75/2272* (2021.05); *B65H 75/2281* (2021.05)

(58) Field of Classification Search
CPC .... B65H 75/14; B65H 75/22; B65H 75/2245; B65H 75/2263; B65H 75/2272; B65H 75/2281
See application file for complete search history.

(56) References Cited

U.S. PATENT DOCUMENTS

| | | | |
|---|---|---|---|
| 1,679,573 | A | 8/1928 | Hind |
| 3,704,838 | A | 12/1972 | Bemier et al. |
| 4,234,137 | A | 11/1980 | Watanabe et al. |
| 5,379,965 | A | 1/1995 | Isler et al. |
| 6,343,765 | B1 | 2/2002 | Wen |

(Continued)

FOREIGN PATENT DOCUMENTS

| | | |
|---|---|---|
| AU | 778927 B2 | 12/2004 |
| CN | 208218086 U | 12/2018 |

(Continued)

OTHER PUBLICATIONS

Mosserberg Industries, Inc.—Knockdown Reels product description, downloaded Mar. 2, 2021 from https://www.mossbergind.com/knock-down-reels/; 3 pages.

(Continued)

*Primary Examiner* — Sang K Kim
(74) *Attorney, Agent, or Firm* — Nelson Mullins Riley & Scarborough LLP

(57) ABSTRACT

A locking system for a spool comprising a barrel, a flange, and a sliding lock. The sliding lock has at least one rail that slidably engages with at least one barrel detent and at least one flange detent to prevent rotation of the flange on the barrel. The sliding lock comprises at least one arm with at least one catch. The at least one catch can be removably locked into at least one recess on the flange.

19 Claims, 36 Drawing Sheets

(56) References Cited

U.S. PATENT DOCUMENTS

| | | | | |
|---|---|---|---|---|
| 8,272,591 | B2 | 9/2012 | Baranov et al. | |
| 8,424,796 | B2 | 4/2013 | Witwer et al. | |
| 8,567,037 | B2 | 10/2013 | Ripplinger | |
| 11,697,569 | B2 * | 7/2023 | Fratianni ..... | B65H 75/2272 242/608.6 |
| 2005/0279877 | A1 | 12/2005 | Lorenzo Barroso | |
| 2007/0262192 | A1 | 11/2007 | Derendal | |

FOREIGN PATENT DOCUMENTS

| | | | |
|---|---|---|---|
| DE | 3106165 | A1 | 12/1981 |
| DE | 19706832 | C1 | 7/1998 |
| WO | 2000208107 | A1 | 1/2002 |

OTHER PUBLICATIONS

IDM Imagineering—Recycling the Filament Reel; downloaded Mar. 2, 2021 from https://imgur.com/t/3dprint/DvhSJ7r, 4 pages.
International Preliminary Report of Patentability for International application No. PCT/US2022/015190 dated Aug. 29, 2023; 8 pages [art has been previously cited].

* cited by examiner

SLIDING LOCK FOR BREAK-DOWN SPOOL

CROSS-REFERENCE TO RELATED APPLICATIONS

This application is a continuation of U.S. patent application Ser. No. 17/190,136 filed on Mar. 2, 2021, entitled "SLIDING LOCK FOR BREAK-DOWN SPOOL", which is incorporated herein in its entirety.

FIELD OF THE DISCLOSURE

The present disclosure relates to systems and methods for the assembly of industrial break-down spools.

BACKGROUND OF THE DISCLOSURE

The present disclosure relates generally to industrial break-down spools and methods of assembling and disassembling such spools. Industrial break-down spools often have two flanges and a barrel which connects the flanges. Industrial materials such as wire, cable, tubing, rope, yarn, or the like may be wound onto the barrel of the spool. The spools can be taken apart (i.e. the flanges removed from the barrel) during shipping or after use, for example, to conserve space and minimize shipping costs.

Typically, the flanges and barrel of an industrial spool twist and lock together with integral holding snaps on the flange that are very stiff in order to maintain the barrel/flange connection during winding and unwinding. To remove the flanges from the barrel, a user must lift the snaps that lock the spool parts together, often using a specialized tool to pry the snap away from the barrel because the force required to lift the snaps is greater than can be achieved manually with a finger. This is undesirable because users generally prefer to avoid purchasing, managing, and using special tools where possible. In addition, if the snap is damaged or destroyed during use, lifting with the tool, shipment, or the like, the entire flange must be discarded and replaced. The spool may be unusable in such condition.

Through ingenuity and hard work, the inventors have developed a sliding lock for engaging and maintaining an industrial breakdown spool in a locked position. The sliding lock is easily engaged and disengaged without the use of any tool and can be stored within the flange construction when not in use. In addition, extra sliding locks can be stowed within the flange in case of failure, damage, or destruction of a sliding lock. In such case, the flange does not need to be discarded or replaced—merely the lock itself is replaced.

BRIEF SUMMARY OF THE DISCLOSURE

In an embodiment, the invention comprises a locking system for a spool comprising a barrel comprising a first longitudinal end and a second longitudinal end, wherein at least the first longitudinal end comprises at least one barrel detent; a first flange removably affixable to the first longitudinal end of the barrel, wherein the first flange comprises at least one receiving location for a sliding lock, the receiving location comprising: at least one flange detent, wherein the at least one flange detent is aligned with the at least one barrel detent to form at least one track; and at least one sidewall having at least one recessed portion; and a sliding lock comprising: a body portion comprising a proximate end, a distal end, two sides, an outer surface and an inner surface; at least one rail disposed on the inner surface of the body portion, wherein the at least one rail is slidable in the at least one track; at least one flexible arm, wherein the at least one arm initiates near the proximate end of the body portion and extends adjacent to one of the sides of the body portion, toward the distal end of the body portion; and at least one catch disposed on the at least one arm, wherein the catch is configured to slidably move into the at least one recessed portion of the flange receiving location and is restricted from moving out of the at least one recessed portion.

In another embodiment, the invention comprises a locking system for a spool comprising: a barrel comprising a first longitudinal end and a second longitudinal end, wherein at least the first longitudinal end comprises at least one barrel detent; a first flange removably affixable to the first longitudinal end of the barrel, wherein the first flange comprises at least one receiving location for a sliding lock, the receiving location comprising: at least one flange detent, wherein the at least one flange detent is aligned with the at least one barrel detent to form at least one track; and at least one sidewall having at least one recessed portion; and a sliding lock comprising: a body portion comprising a proximate end, a distal end, two sides, an outer surface and an inner surface; at least one rail disposed on the inner surface of the body portion, wherein the at least one rail is slidable in the at least one track; at least one flexible arm, wherein the at least one arm initiates near the proximate end of the body portion and extends adjacent to one of the sides of the body portion, toward the distal end of the body portion; and at least one catch disposed on the at least one arm; wherein the locking system comprises: a first locked position wherein the at least one rail is positioned in the at least one track and the at least one catch is positioned within the at least one recessed portion; and a second unlocked position wherein the at least one rail is not positioned within the at least one barrel detent and the catch is not positioned within the recessed portion.

In yet another embodiment, the invention comprises a method for locking and unlocking a spool comprising: providing a barrel comprising a first longitudinal end and a second longitudinal end, wherein at least the first longitudinal end comprises at least one barrel detent; providing a first flange comprising at least one receiving location for a sliding lock, the receiving location comprising at least one flange detent and at least one sidewall having at least one recessed portion; removably affixing the first flange to the first longitudinal end of the barrel; aligning the at least one barrel detent with the at least one flange detent to form at least one track; providing a sliding lock comprising: a body portion comprising a proximate end, a distal end, two sides, an outer surface and an inner surface; at least one rail disposed on the inner surface of the body portion; at least one flexible arm, wherein the at least one arm initiates near the proximate end of the body portion and extends adjacent to one of the sides of the body portion, toward the distal end of the body portion; and at least one catch disposed on the at least one arm; slidably engaging the at least one rail with the at least one track; and sliding the sliding lock into a first locked position wherein the at least one rail is positioned in the at least one track within the at least one barrel detent and the at least one catch is positioned within the at least one recessed portion; or sliding the sliding lock into a second unlocked position wherein the at least one rail is not positioned within the at least one barrel detent and the catch is not positioned within the recessed portion.

Further, the invention is directed to a locking system for a spool comprising: a barrel comprising a first longitudinal end and a second longitudinal end, wherein at least the first longitudinal end comprises at least one barrel detent; a first flange removably affixable to the first longitudinal end of the barrel, wherein the first flange comprises at least one receiving location for a sliding lock, the receiving location comprising: at least one flange detent, wherein the at least one flange detent is aligned with the at least one barrel detent to form at least one track; and at least one sidewall having at least one recessed portion; and a sliding lock comprising: a body portion comprising a proximate end, a distal end, two sides, an outer surface and an inner surface; at least one rail disposed on the inner surface of the body portion, wherein the at least one rail is slidable in the at least one track; at least one flexible arm, wherein the at least one arm initiates near the proximate end of the body portion and extends adjacent to one of the sides of the body portion, toward the distal end of the body portion; at least one catch disposed on the at least one arm, wherein the catch is configured to slidably move into the at least one recessed portion of the flange receiving location and is restricted from moving out of the at least one recessed portion; a retaining portion extending from the distal end of the sliding lock, opposite the proximate end, wherein the retaining portion is configured to snap-fit onto a portion of a rib of the flange; and a lip extending from the proximate end of the sliding lock, opposite the distal end, wherein the lip is configured to engage with the flange within the receiving location.

In an embodiment, the sliding lock of the invention engages with an industrial spool flange and barrel. In the locked position, the sliding lock prevents the flange from rotating on the barrel and prevents disassembly of the spool. In an embodiment, the sliding lock has two rails that slide into detents in the flange and barrel, preventing flange rotation on the barrel. The sliding lock is removable and replaceable, without the need to replace the entire flange or barrel. The sliding lock is snap-fit into the flange and/or barrel in an embodiment, utilizing flexing arms and catches that lock it into place. The sliding lock can be engaged by sliding the lock radially inward (locked), with reference to the flange, and disengaged by squeezing the arms and sliding the lock radially outward (unlocked).

Depending on various factors, such as how heavy the wound media is, the industrial spool and sliding lock system may be configured for assembly in various ways, such as, for example, a flange comprising: (1) one sliding lock and no snaps (also referred to herein as locking tabs or flexible tabs); (2) one sliding lock in conjunction with a snap; or (3) two sliding locks and no snaps. If a snap is utilized, the snap may serve as a visual aid, making it easier to align the flange onto the barrel. Additionally, when the sliding lock is removed from the flange, there is a direct line of sight to the detents on the barrel, making it easier to align the flange to the barrel.

Other features of the present invention and combinations of features will become apparent from the detailed description to follow, taken in conjunction with the accompanying drawings.

BRIEF DESCRIPTION OF THE SEVERAL VIEWS OF THE DRAWING(S)

For the purpose of illustrating the invention, the drawings show forms that are presently preferred. It should be understood that the invention is not limited to the precise arrangements and instrumentalities shown in the drawings.

Figure 20:
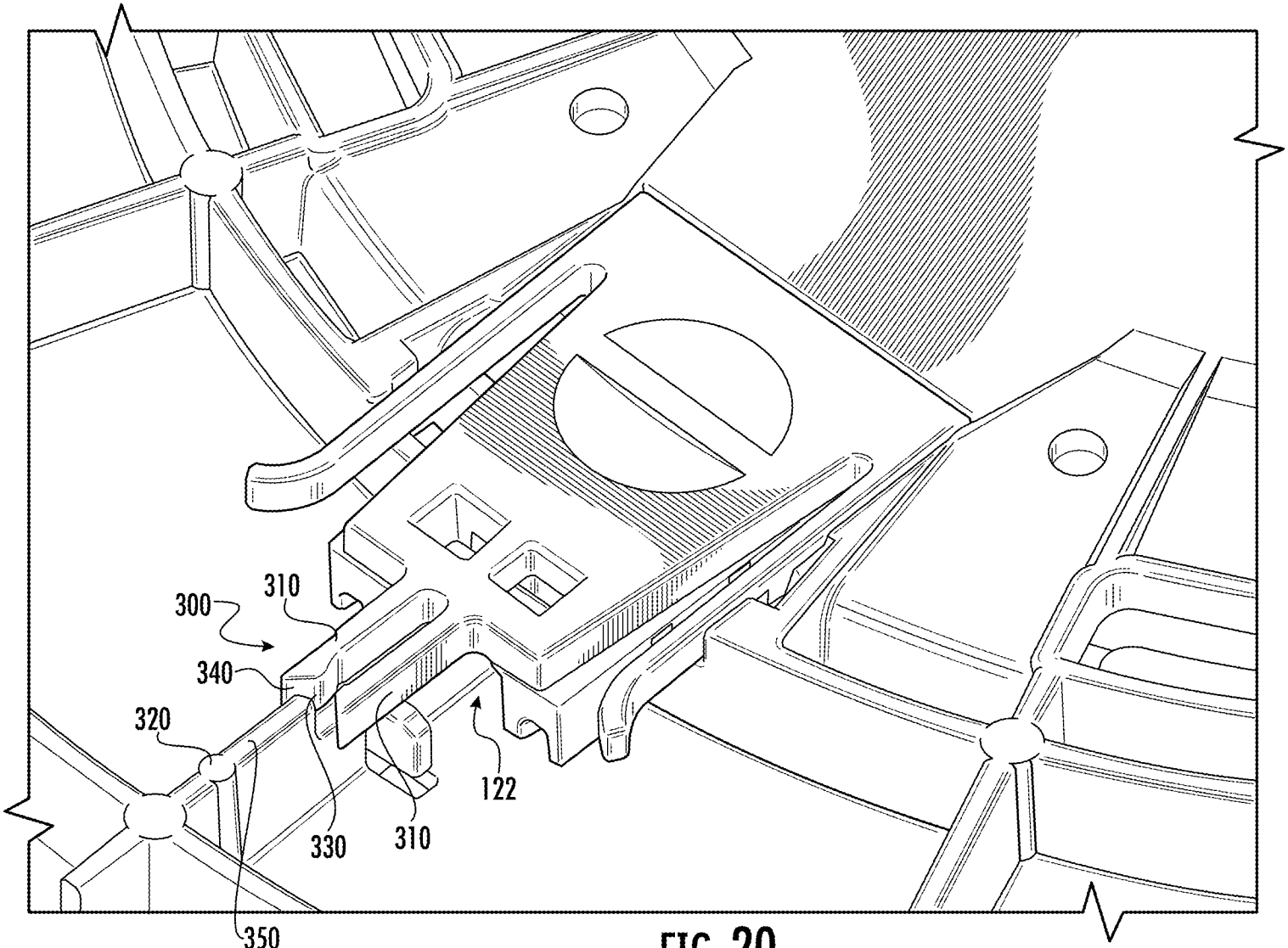
FIG. 20 illustrates an alternate embodiment of the sliding lock in a locked configuration in an embodiment of the invention.

FIGS. 22A-22D comprise various views (top, bottom, rear, front) of the sliding lock of FIG. 20 in an embodiment of the invention.

Figure 23:
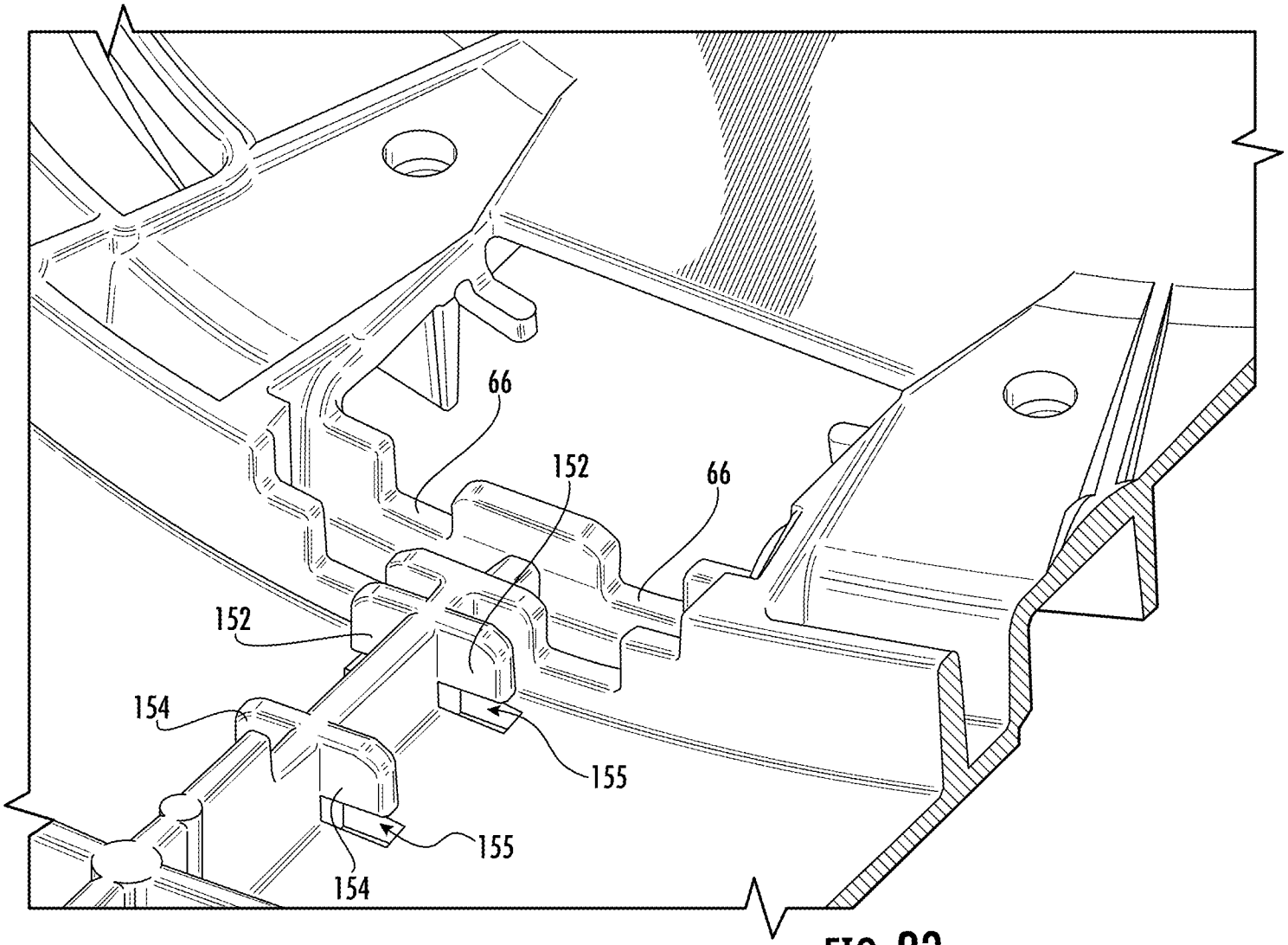

FIG. 23 illustrates a view of the flange location for insertion of the sliding lock of the invention, in an embodiment.

Figure 24:
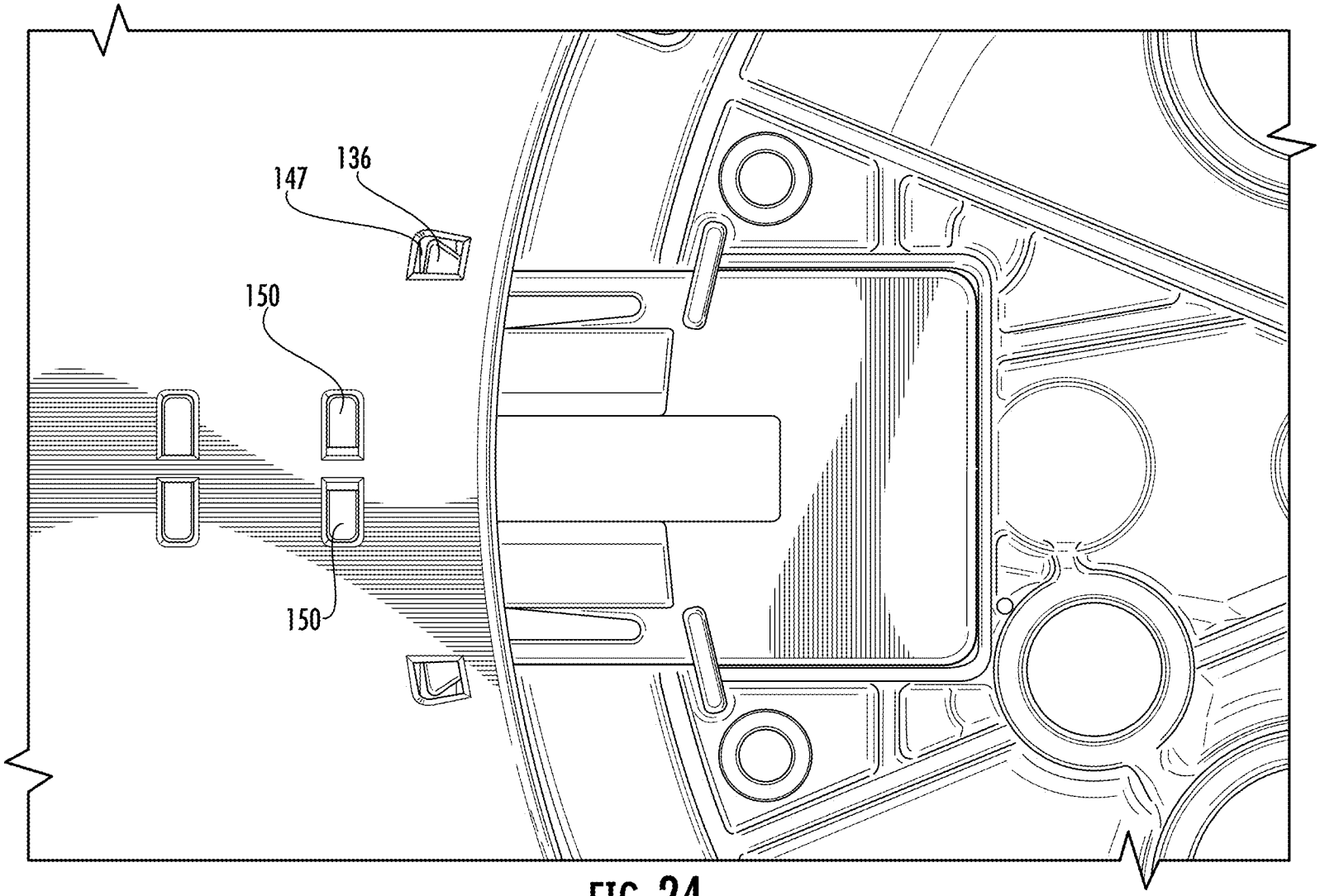

FIG. 24 illustrates the inner surface of the flange, nearest the barrel, with the sliding lock of FIG. 20 in a locked configuration in an embodiment of the invention.

Figure 25:
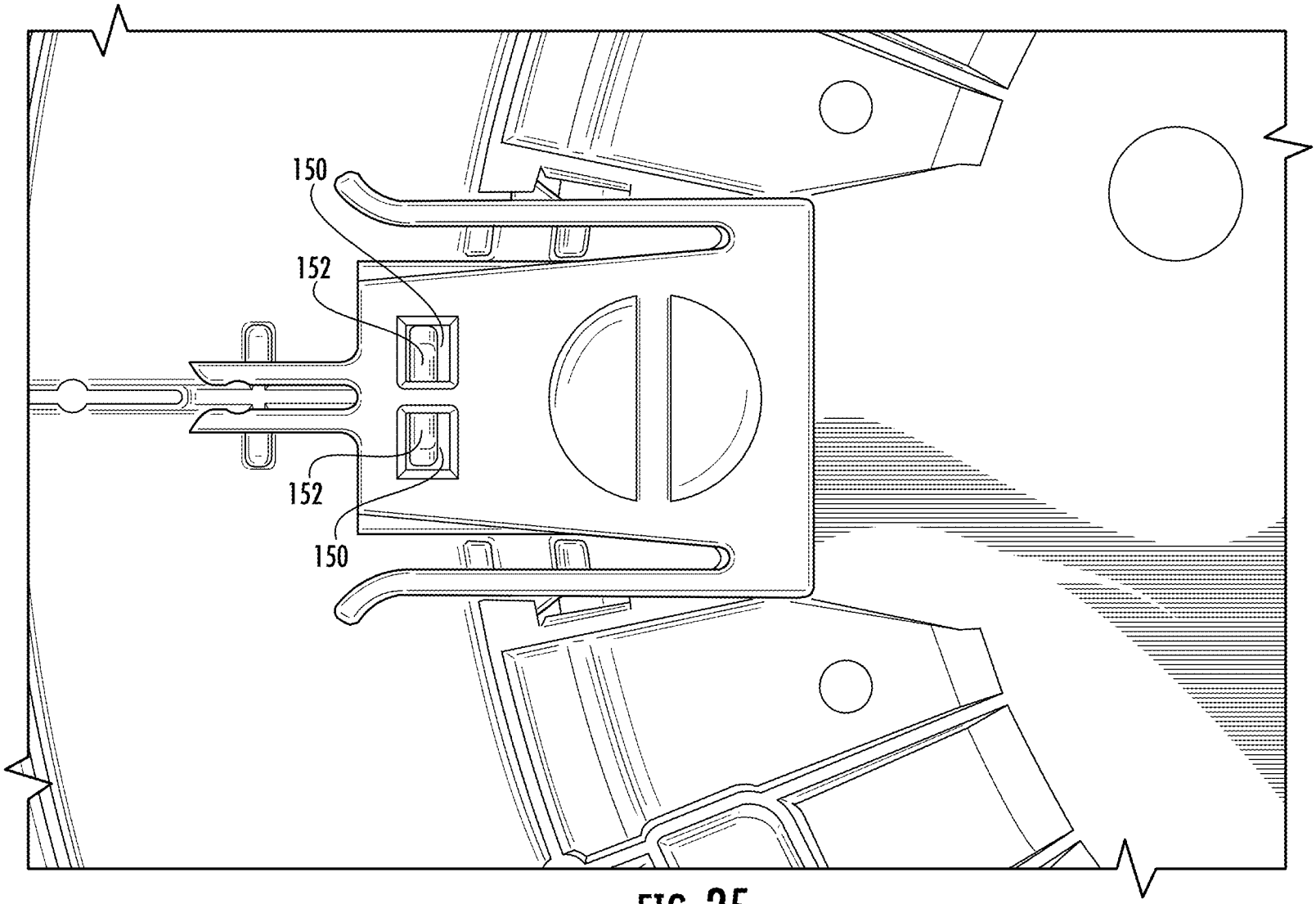

FIG. 25 illustrates the outer side of the flange with the sliding lock of FIG. 20 in a locked configuration in an embodiment of the invention.

Figure 26:
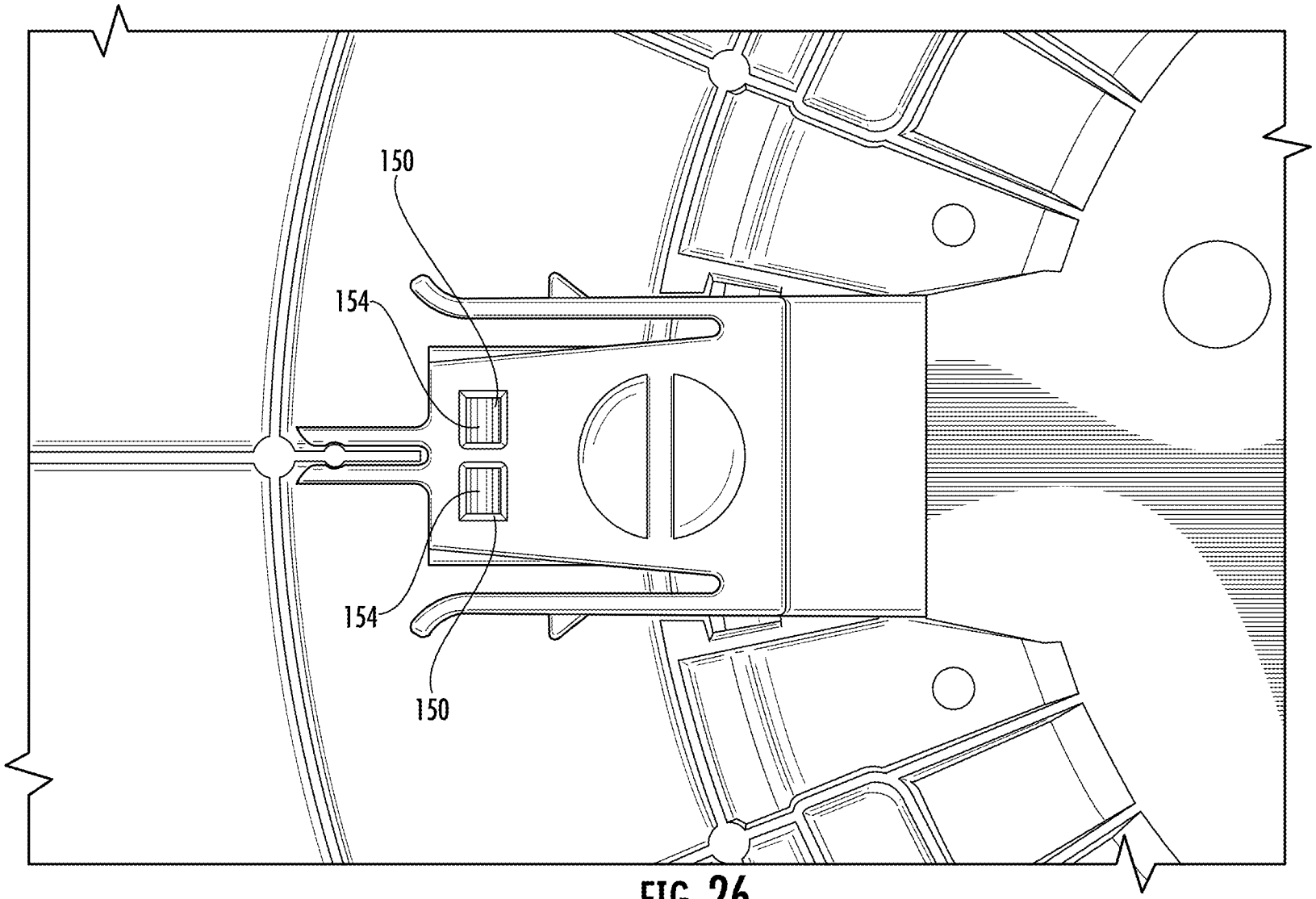

FIG. 26 illustrates the outer side of the flange with the sliding lock of FIG. 20 in an unlocked configuration in an embodiment of the invention.

Figure 27:
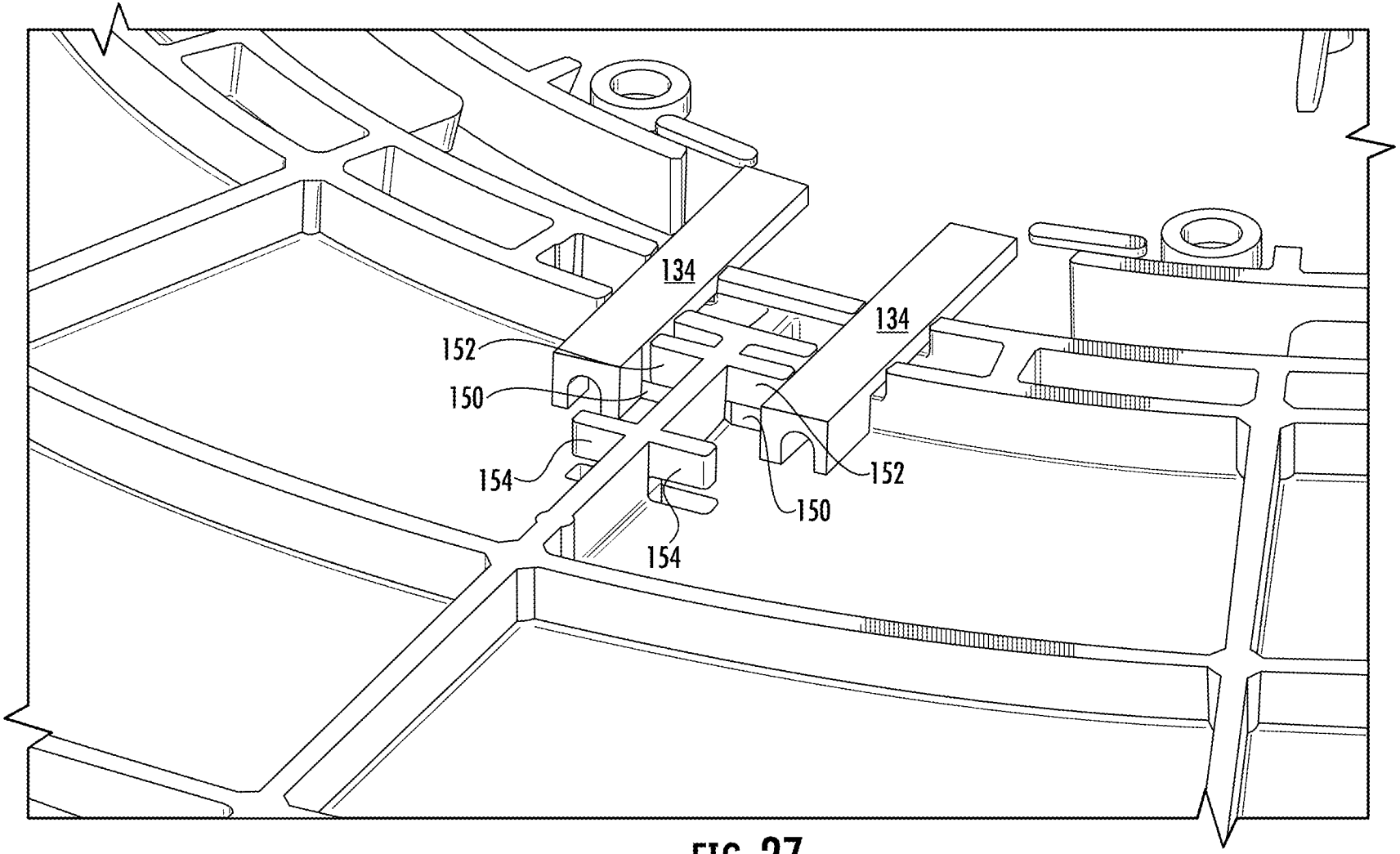

FIG. 27 illustrates an isolated view of the rails of the sliding lock, in an embodiment of the invention.

Figure 28:
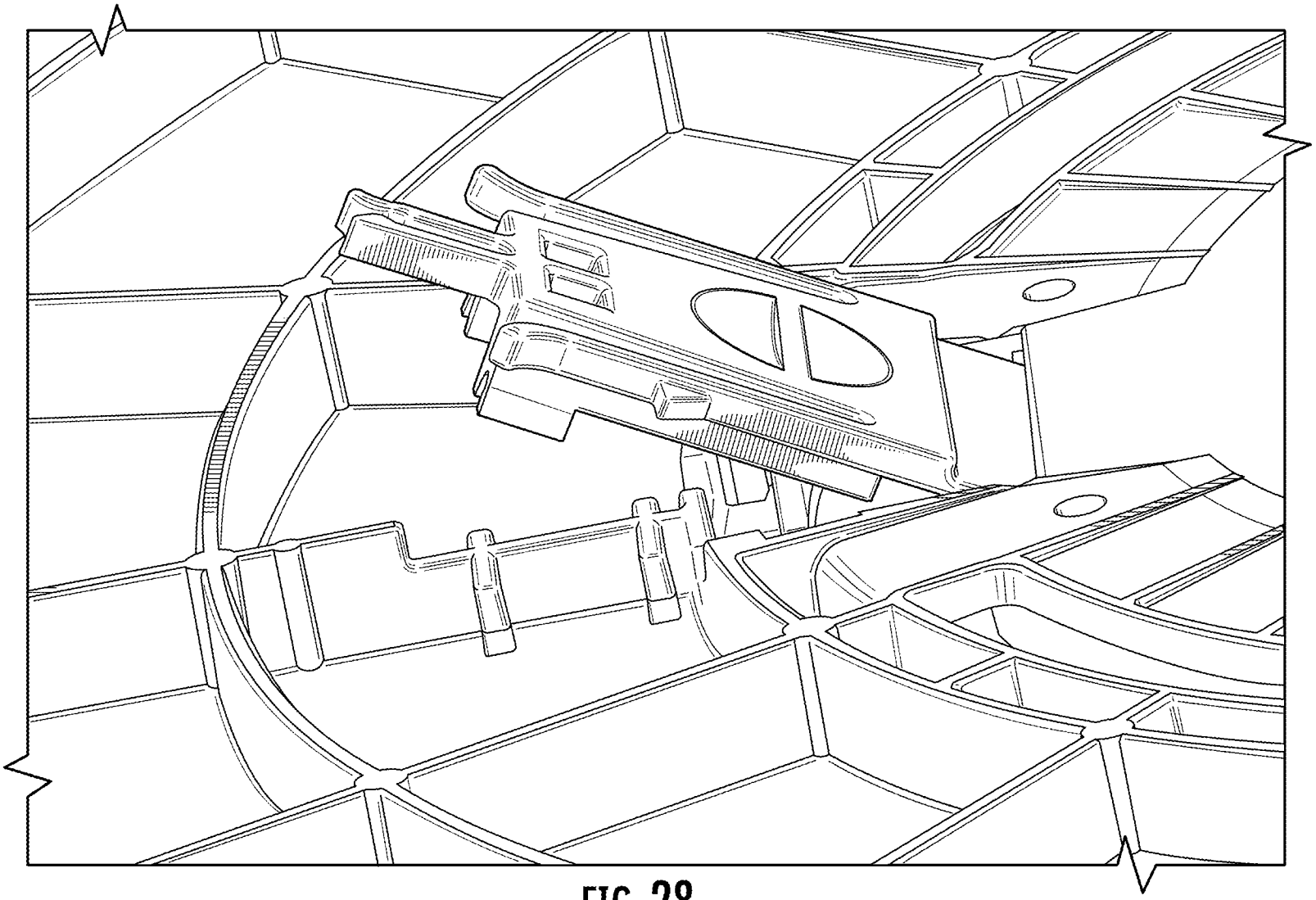
Figure 29:
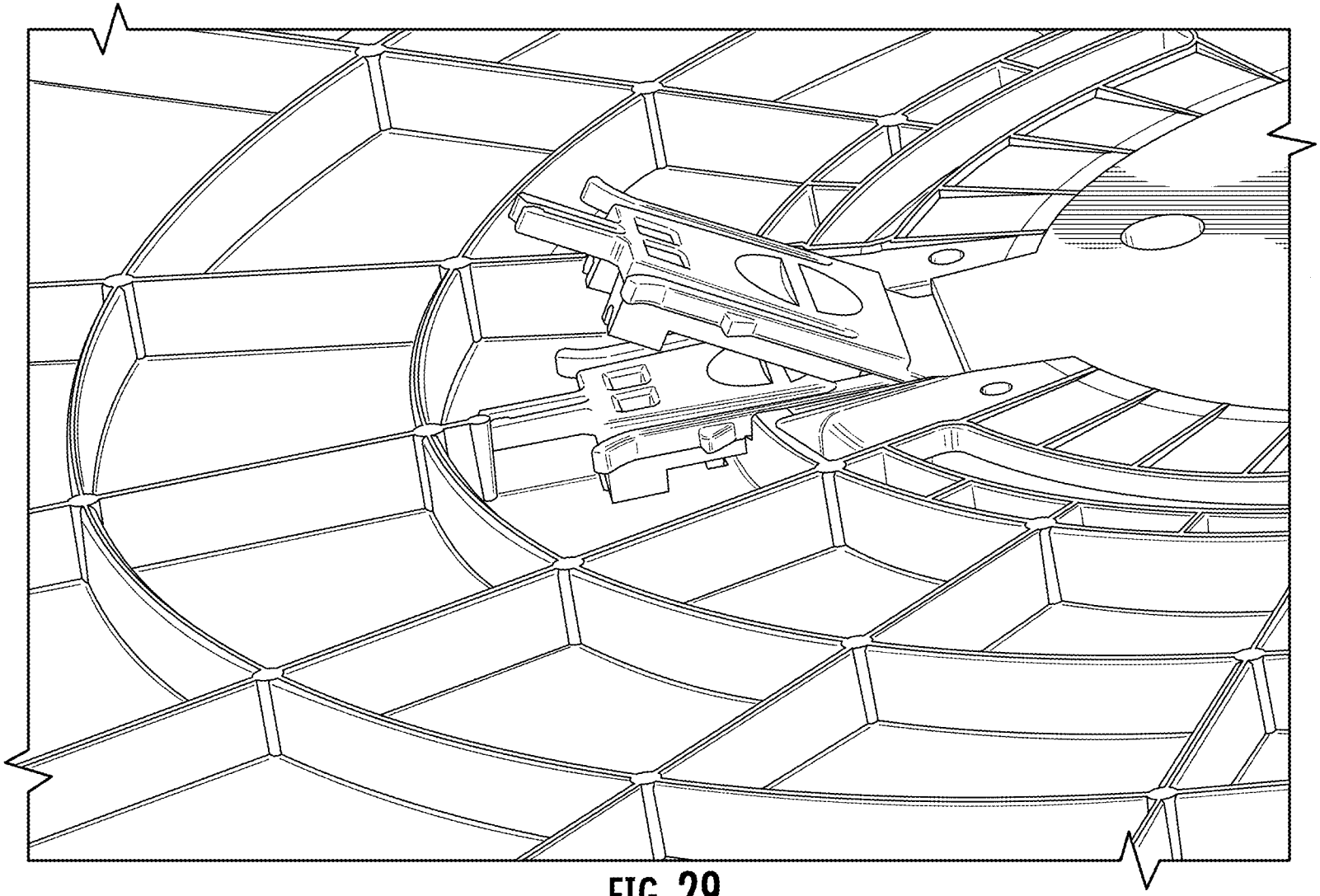

FIGS. 28-29 illustrate a method of insertion or retraction of the sliding lock of FIG. 20 from the flange, in an embodiment of the invention.

Figure 30:
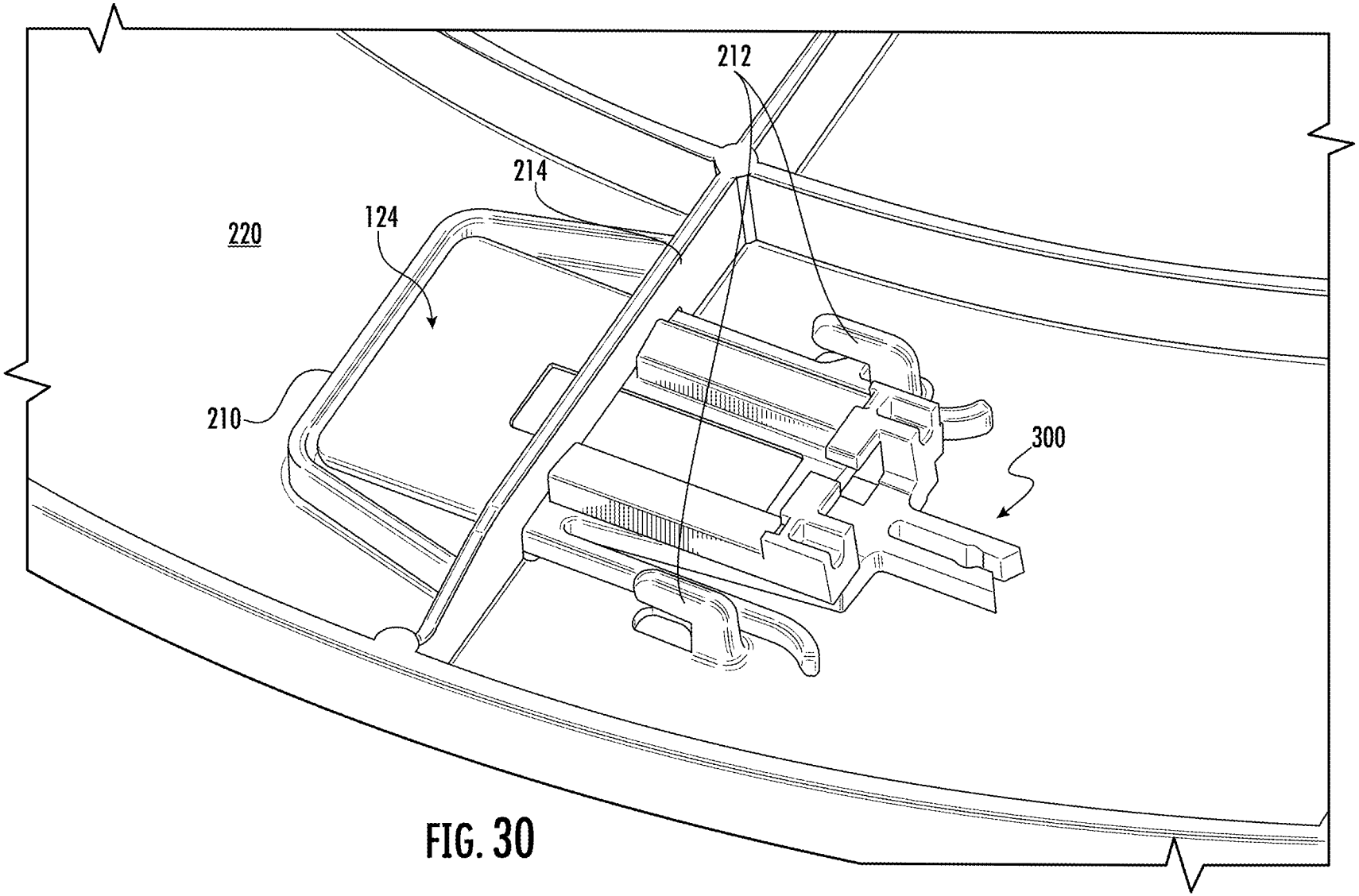

FIG. 30 illustrates the sliding lock of FIG. 20 in a stowed position along the edge of a flange, in an embodiment of the invention.

Figure 31:
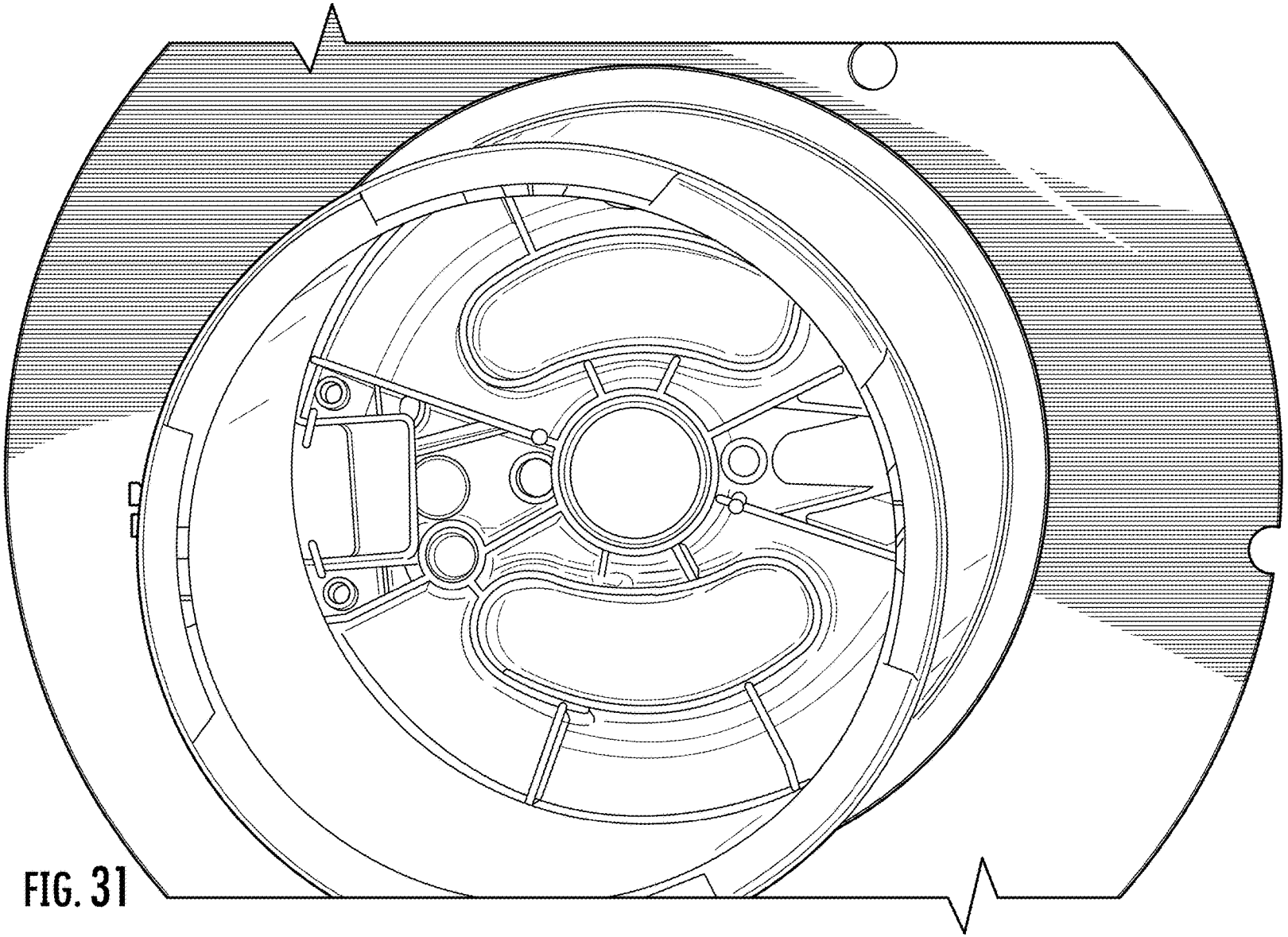

FIG. 31 illustrates a view of the barrel, flange, and sliding lock in an unlocked configuration, in an embodiment of the invention.

Figure 32:
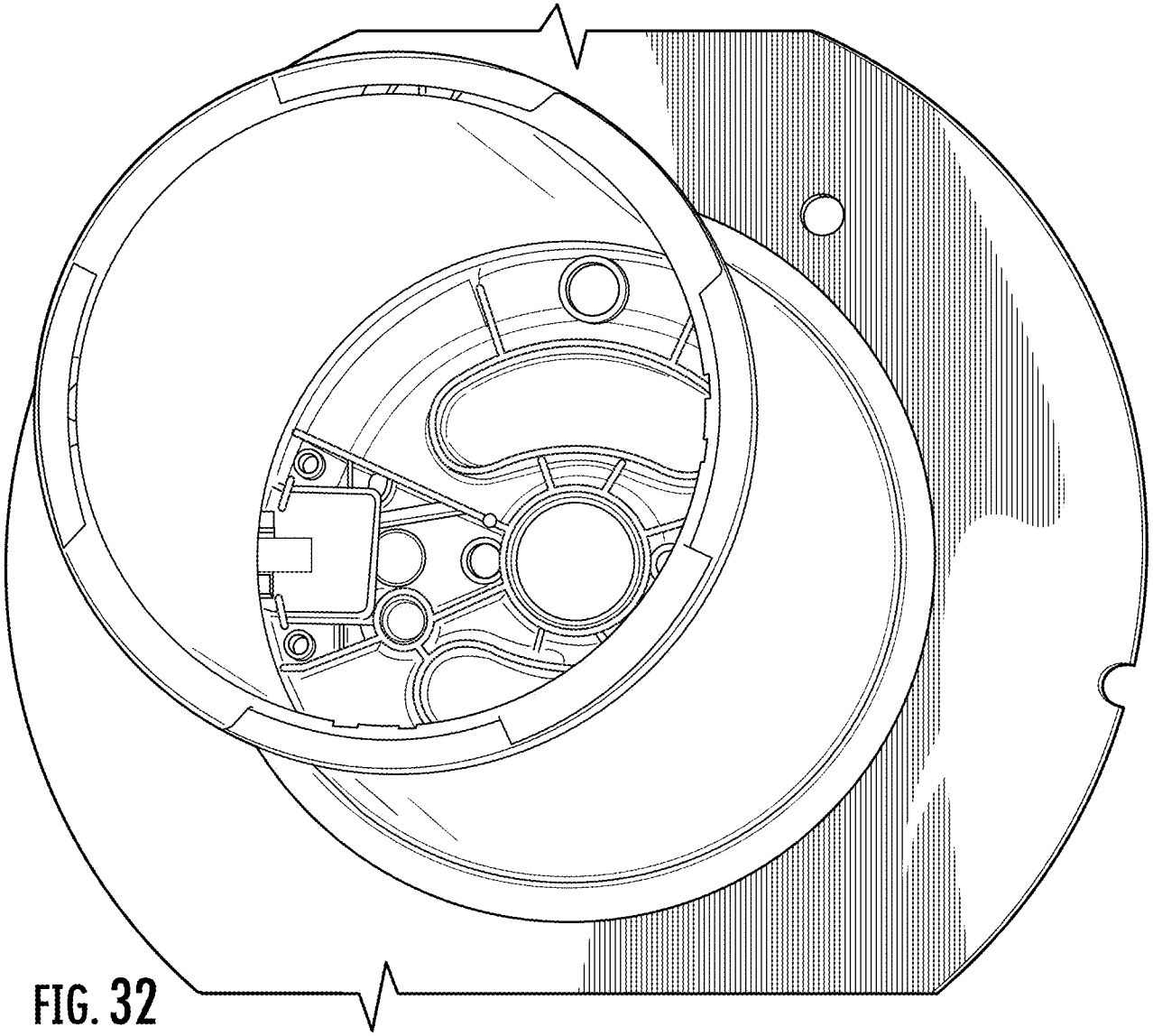

FIG. 32 illustrates a view of the barrel, flange, and sliding lock in a locked configuration, in an embodiment of the invention.

Figure 33:
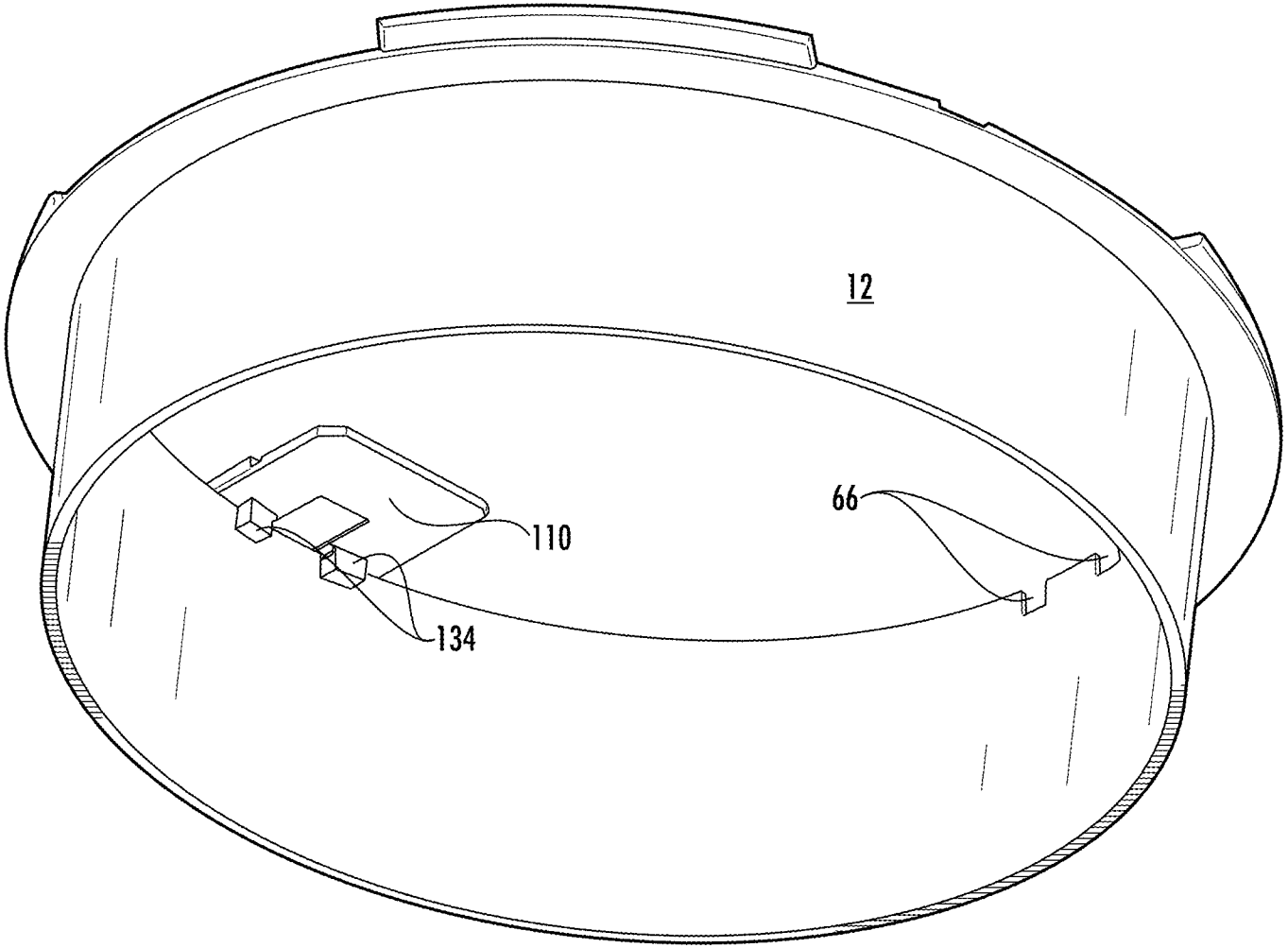

FIG. 33 illustrates the barrel and sliding lock in an embodiment of the present invention.

DETAILED DESCRIPTION OF THE DISCLOSURE

The present invention relates to a breakdown spool of the type having a barrel and at least one flange formed separately from the barrel. The barrel is defined by a longitudinal axis, a substantially annular winding surface surrounding the longitudinal axis, and an insertion section formed on at least one axial end of the barrel. In one aspect of the present invention, the insertion section includes an annular ring spaced from the axial end of the barrel and projecting radially from the winding surface. The flange includes a support surface and a receiving channel formed within the support surface. The receiving channel is provided for receiving the insertion section of the barrel to form the completed spool. The receiving channel includes a first portion for receipt of the axial end of the barrel and a second portion for receiving the annular ring of the insertion section. The second portion of the channel is recessed within the support surface such that the annular ring mates with and aligns, preferably flush, with the support surface on the flange upon insertion of the axial end of the barrel into the receiving channel.

The barrel and/or flange(s) may comprise integrally molded thermoplastic material and the barrel may be substantially centrally hollow, the hollow portion defined by an inside wall of the winding surface. In a further aspect of the flange, the receiving channel within the flange may include an internal support wall, positioned to fit within the portion of the central hollow at the insertion section. The internal support wall may be formed at an inwardly directed acute angle with respect to the inside wall of the barrel when the insertion section of the barrel is secured within the receiving channel. The angle of the support wall preferably creates a space between a portion of the support wall and the inside wall of the barrel. In addition, a plurality of support tabs may be formed inwardly of the support wall for structurally stiffening the support wall.

In a further aspect of the spool, the receiving channel may include an outer wall formed at an acute angle with respect to the longitudinal axis of the barrel when the insertion section of the barrel is secured within the receiving channel. The barrel also includes an extension foot directed radially outward from the insertion section adjacent the axial end. The foot portion is located on the barrel axially outward of the annular ring. The foot preferably engages the outer wall of the receiving channel when the insertion end of the barrel is secured within the receiving channel. The fixing means portion of the locking mechanism may be formed at least partially within the foot on the barrel end, with the foot forming the notch for receipt of the protrusion on the end of the flexible tab.

In a further aspect of the spool, a plurality of spaced extension feet are provided, with each foot preferably forming a radial projection on the outer surface of the axial end of the barrel. Each extension foot projection is contemplated to fit within the space created by the projections within the receiving channel. Upon radial rotation of the barrel within the receiving channel, the projections and protrusions are contemplated to overlap and, in an embodiment, axially lock the barrel within the receiving channel. In other embodiments which will be described herein, at least one sliding lock is utilized to lock the barrel within the receiving channel.

Other features of the present invention and combinations of features will become apparent from the detailed description to follow, taken in conjunction with the accompanying drawings.

Figure 1:
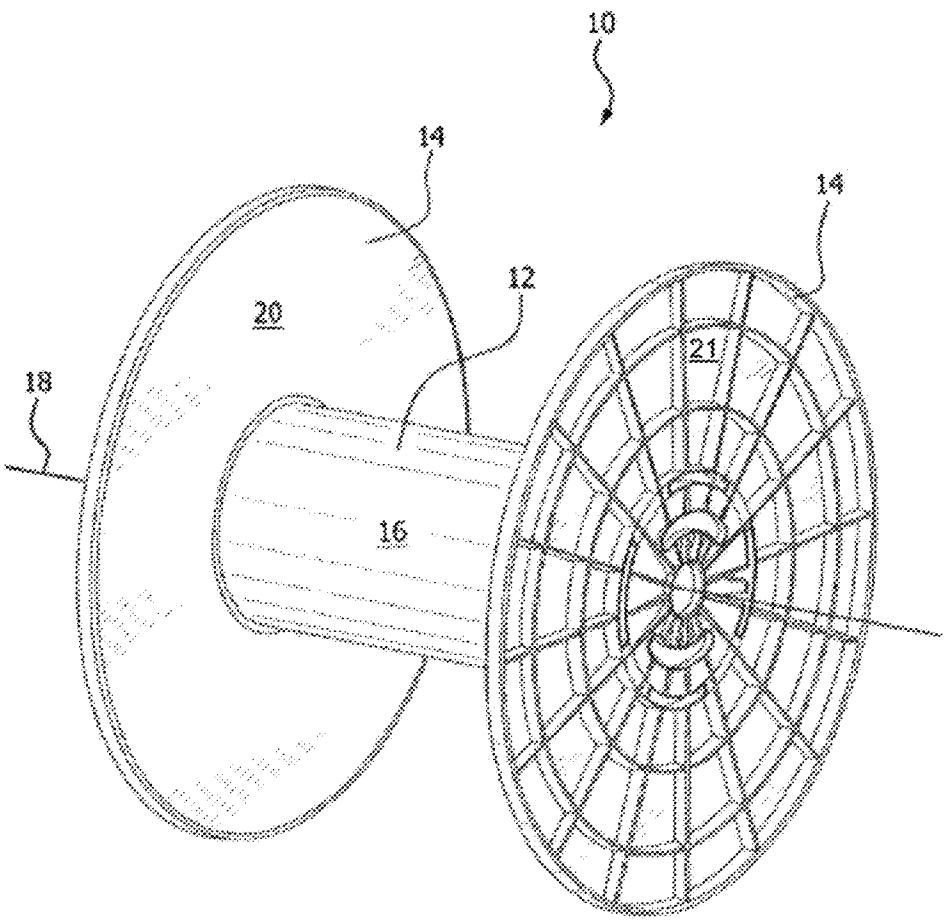
FIG. 1 shows a perspective view of an embodiment of a spool having features contemplated by the present invention.

Referring to the figures, where like numerals identify like elements, there is shown an embodiment of a breakdown spool designated by the numeral 10. As generally shown in FIG. 1, the spool 10 is comprised of a barrel 12 and one or more flanges 14. Two flanges 14 are shown in the figures, although a functional winding spool may include only a single flange, if desired. The barrel 12 as shown is defined by an annular winding surface 16, which is generally formed about a longitudinal axis 18. The flanges 14 include a support surface 20 directed inwardly towards the winding surface 16 of the barrel 12 and a second support surface 21 directed outwardly away from the winding surface 16 of the barrel 12. The winding surface 16 and the support surface(s) 20 form engagement surfaces for the elongate material (not shown) to be wound on the spool 10.

Figure 2:
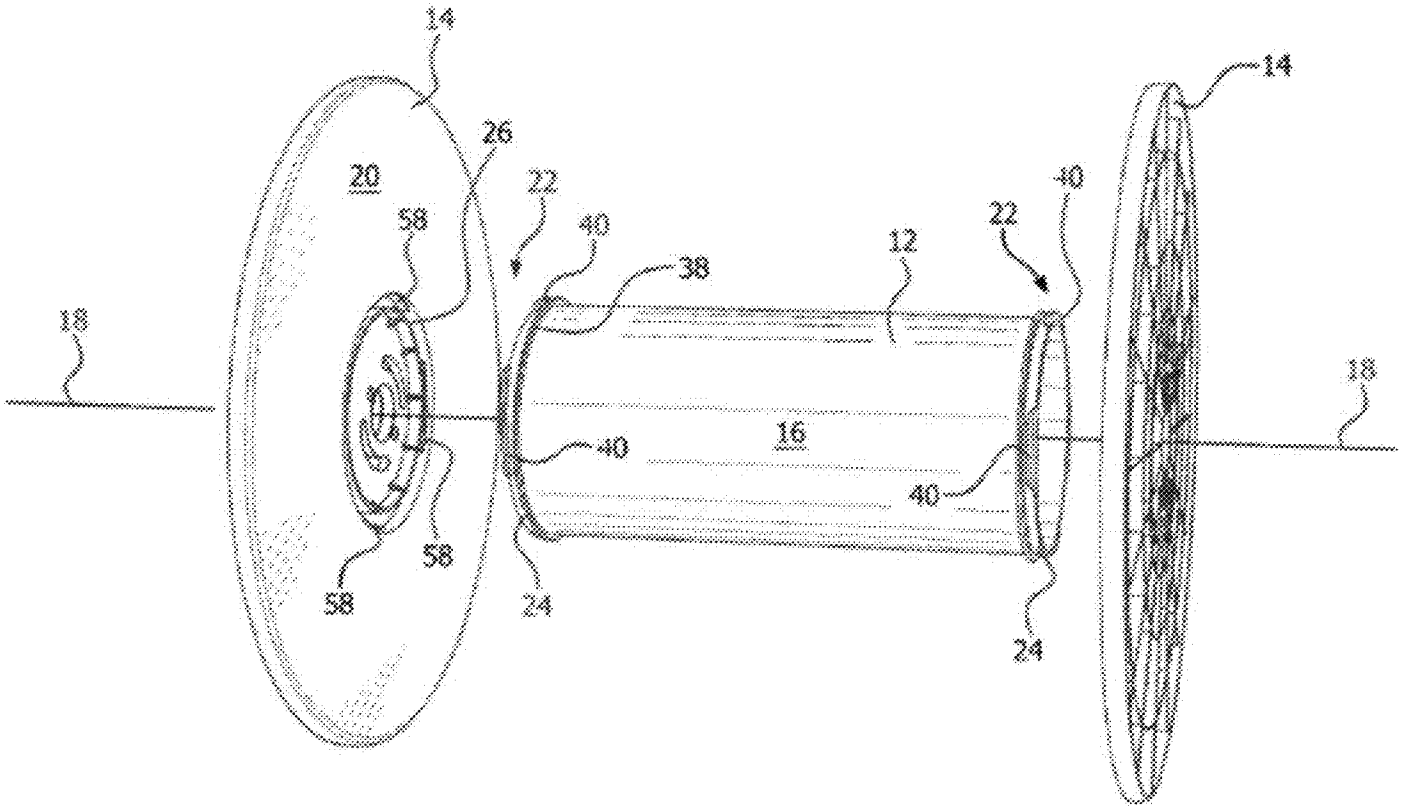
FIG. 2 shows an exploded perspective view of the spool of FIG. 1.

In FIG. 2, the spool 10 is shown with its constituent parts being separated. As illustrated, the barrel 12 includes an insertion section 22 on each longitudinal end 24. Formed within the support surface 20 of each flange 14 is a receiving channel 26 having a generally circular form. The connection of one of the flanges to one end of the barrel is described below. It should be understood that in a two-flange construction, each flange will be formed in a similar fashion, as will each end of the barrel. In addition, the barrel structure is contemplated to be integrally molded. Similarly, the structure of the flange preferably has an integrally molded construction.

Figure 3:
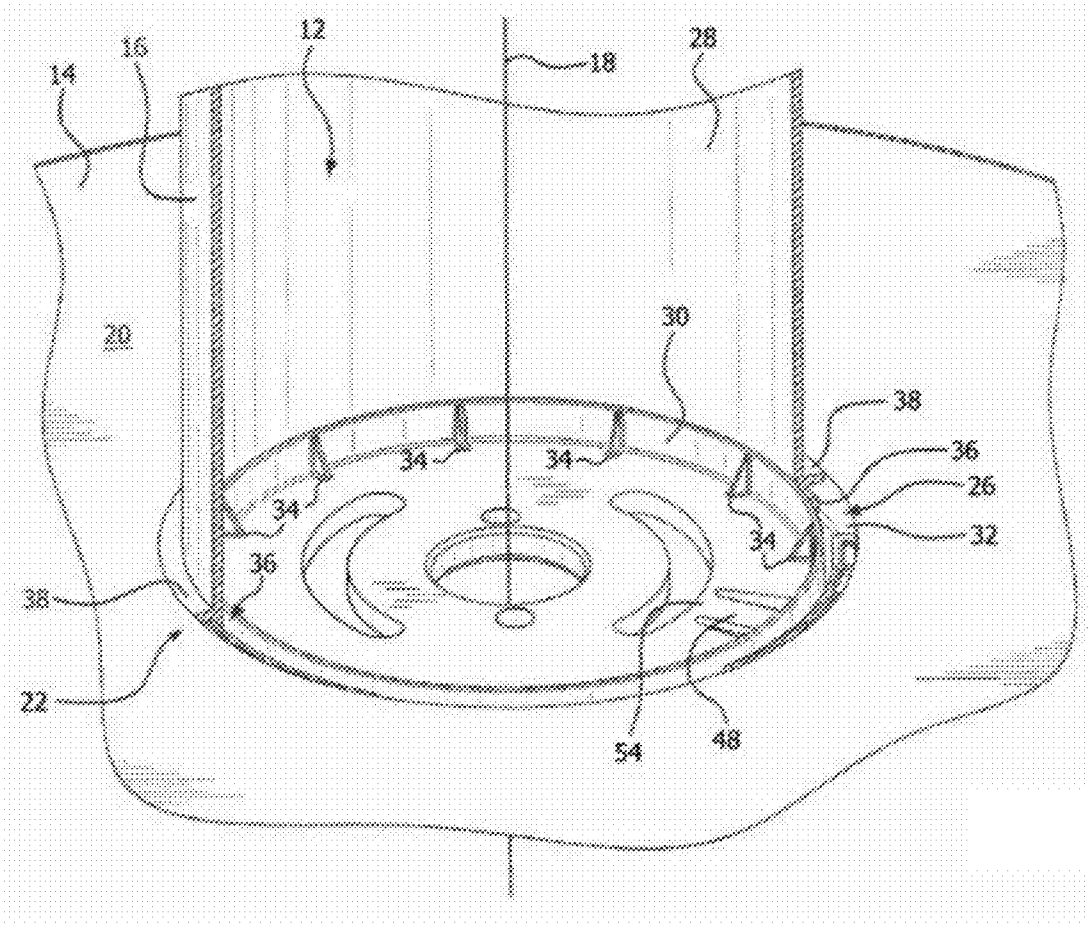
FIG. 3 shows a partial cross-sectional view of a portion of the spool of FIGS. 1 and 2.

In FIG. 3, there is shown the interaction of the insertion section 22 on the axial end 24 of the barrel 12 with the receiving channel 26 of the flange 14. The barrel 12 is shown in section with the winding surface 16 directed radially outward and surrounding the longitudinal axis 18. The inner portions of the barrel 12 define a cylindrical central hollow having an inner wall 28 that is preferably cylindrical. The circular channel 26 as shown includes an inner support wall 30 that is spaced radially inward from an outer wall 32. As detailed further below, the space between the inner wall 30 and the outer wall 32 is formed to receive the insertion section 22 of the axial end 24 of the barrel 12. Stiffening ribs 34 are provided radially inward of the inner wall 30, with the remaining portion of the recess being open. As shown on the rear portion of the flange (opposite of the support surface), a plurality of ribs are provided to strengthen the flange. In addition, various holes or openings are provided in the wall of the central portion of the flange. These openings may provide for engagement by a drive means for the spool and gripping holes for handling the spool during use and assembly.

The insertion section 22 of the barrel 12 includes an axial end portion 36 and an annular ring 38 that projects radially outward from the winding surface 16 of the barrel 12. The axial end portion 36 fits within the channel 26 and is positioned between the inner support wall 30 and the outer wall 32. The annual ring 38 is spaced from the axial end 36 of the barrel 12 and mates with support surface 20 of the flange 14.

Figure 4:
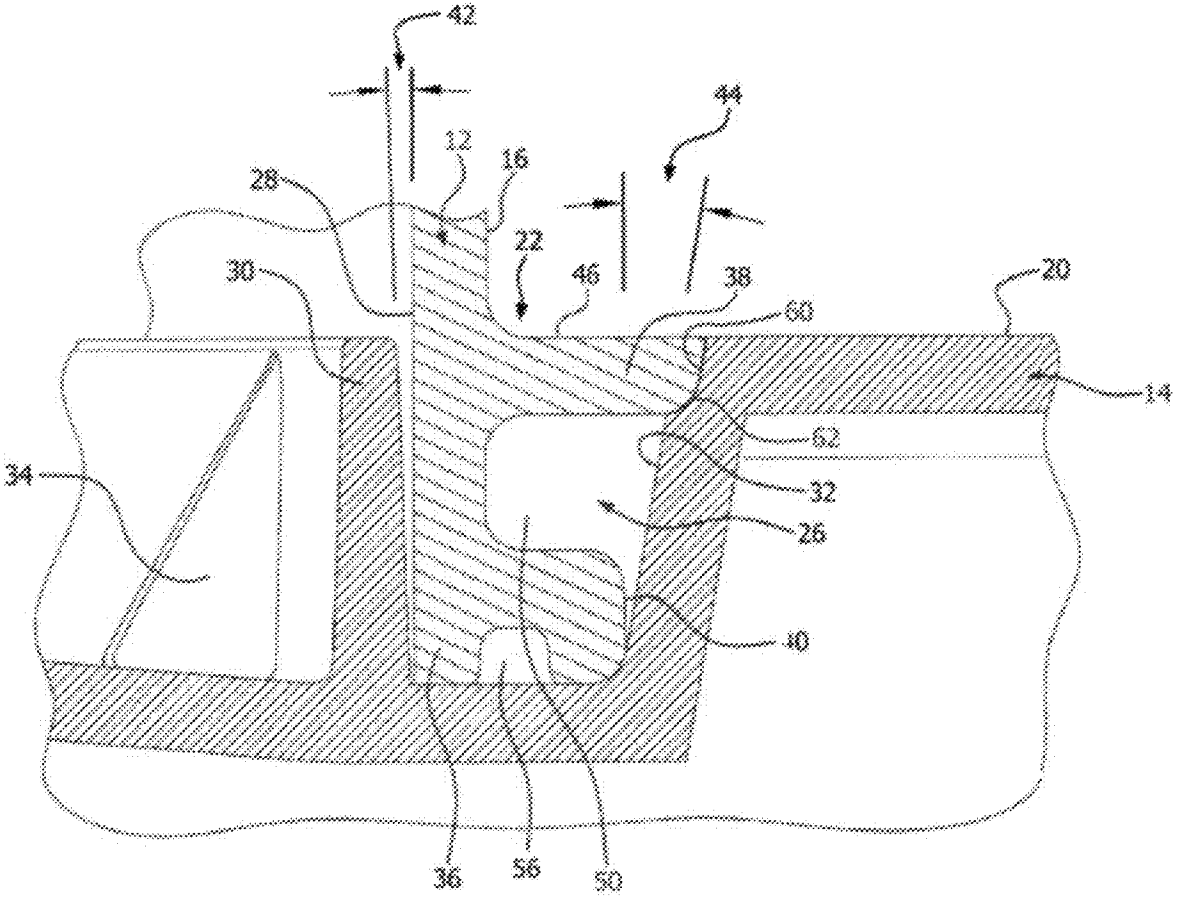
FIG. 4 shows a cross-sectional view of a portion of the connection between the flange and barrel of the spool of FIGS. 1-3.

A cross sectional view of the relative positioning of the insertion section 22 of the barrel 12 within the receiving channel 26 is shown in FIG. 4. The axial end 36 of the insertion section 22 is positioned within the channel 26 between the inner support wall 30 and the outer wall 32. An outwardly directed barrel tab or foot 40 is formed on the axial end 36 and projects from the barrel surface 16. As shown in FIG. 2, multiple feet 40 are provided around the circumference of the end of the barrel 12. Each foot 40 is provided at a spaced location.

As shown in FIG. 4, a space is preferably provided between the inner support wall 30 and the inner wall 28 of the barrel 12. This space is created in part by the inward tapering 42 of the inner support wall 30 relative to the inner barrel wall 28, which is preferably parallel to and concentric with the longitudinal axis 18. The outer wall 32 of the receiving channel 26 as shown is angled 44 relative to the barrel wall 16 and thus the longitudinal axis 18 of the barrel 12. The angle 44 of the outer wall 32 may be in the range of 10 to 15 degrees, relative to a line parallel to the longitudinal axis (18), and may be greater than the taper 42 of the inner support wall 30.

The radial projection of the ring 38 is contemplated to be greater than the projection of the foot 40 from the barrel surface 16. The top surface 46 of the ring 38 is aligned to be flush with the support surface 20 of the flange 14, creating a continuous surface. The projected tip 60 of the ring 38 conforms to a receiving edge 62 of the outer wall 32 of the receiving channel 26. The mating of the ring tip 60 with the receiving edge 62 provides axial support for the ring 38. Below the ring 38 is created an engagement space 50. In the cross section of FIG. 4, the engagement space 50 is further refined by the position of the projecting foot 40.

Figure 5:
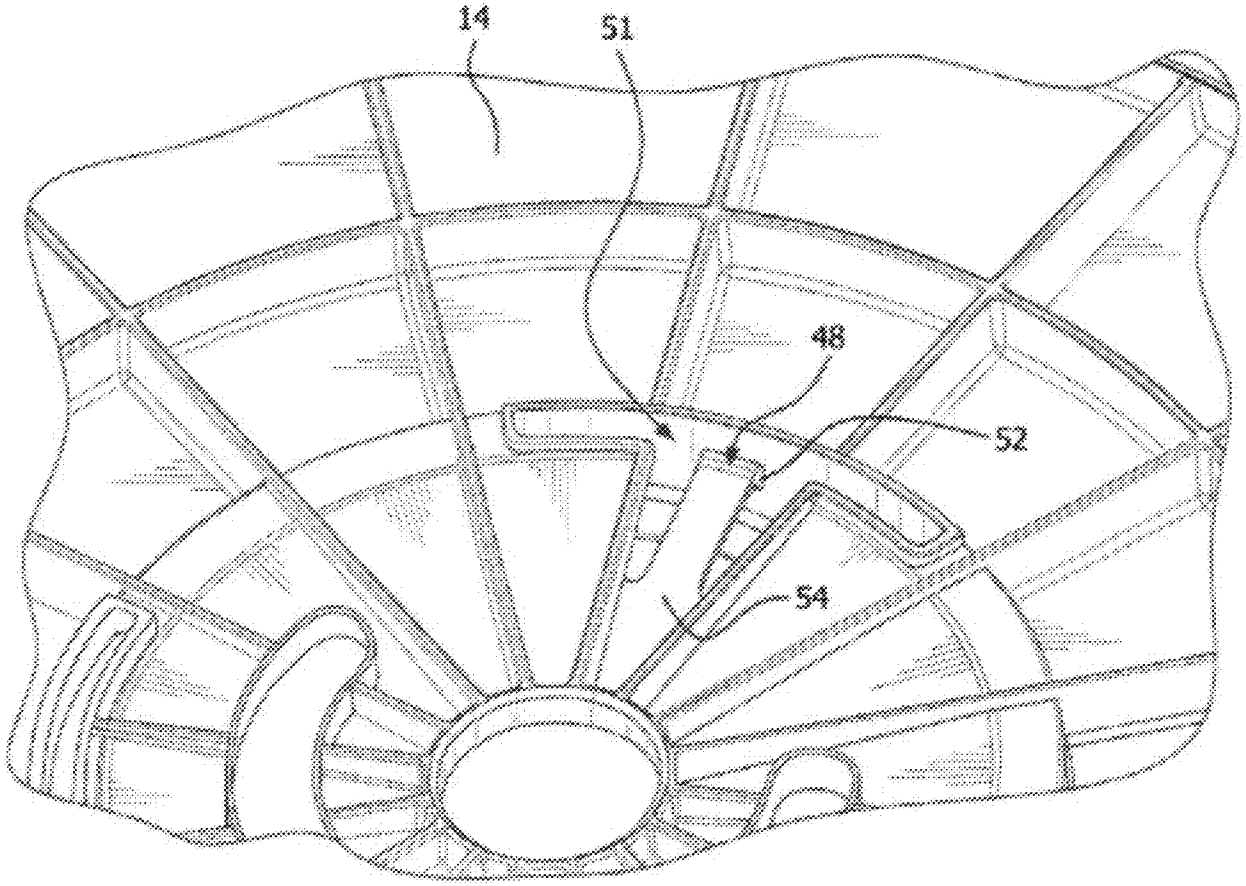
FIG. 5 shows a partial perspective view of an outside surface of a flange portion of the spool of FIGS. 1-3.

In FIG. 5, there is shown an optional locking tab 48 formed as part of the body of the flange 14. The locking tab 48 is formed within an opening 51 within the wall of the flange 14. The tab 48 is cantilevered from a fixed base 54 and contemplated to be flexible, such that a head portion 52 is moveable away from the normal plane of the tab 48. The tab 48 forms a portion of an optional locking mechanism for the barrel 12 and flange 14 by engaging means within the end of the barrel 12 to fix the radial position of the barrel 12 within the receiving channel 26.

Figure 6:
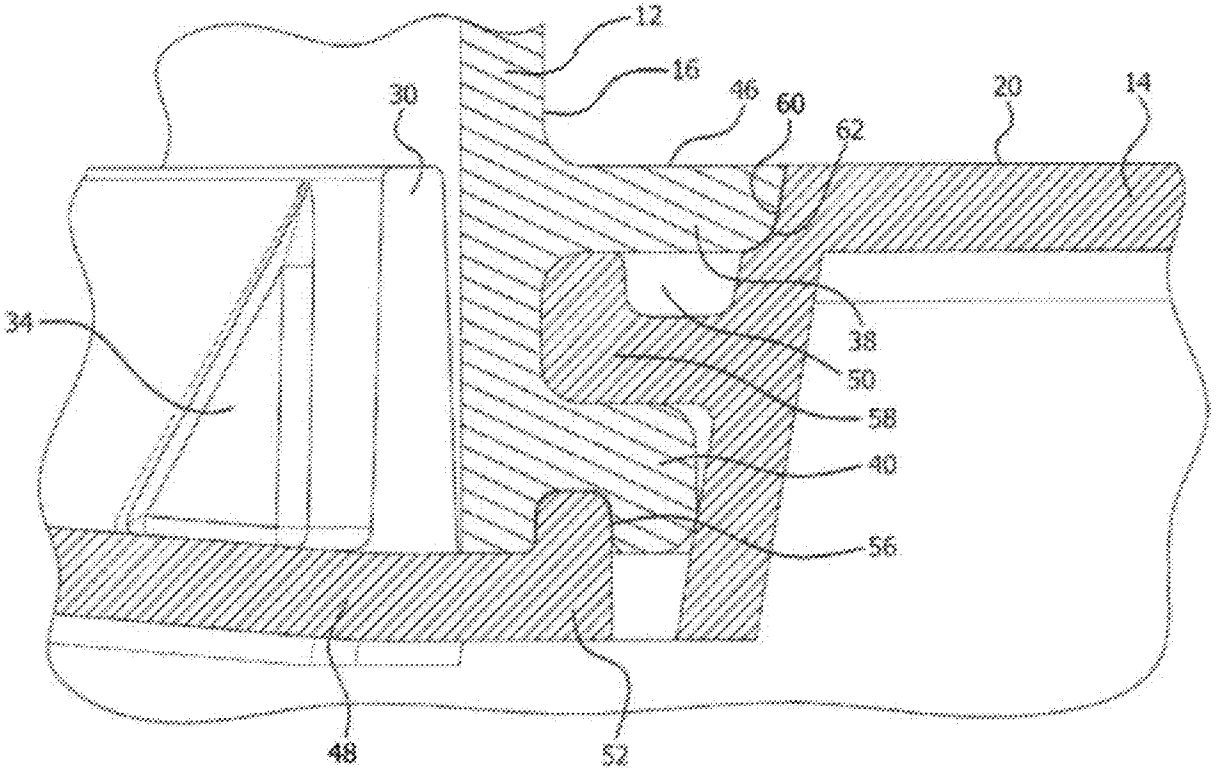
FIG. 6 shows a cross-sectional view at a different radial location than that taken in FIG. 5, with the present view showing a further portion of the connection between the flange and barrel portions of the spool of FIGS. 1-4.
Figure 7A:
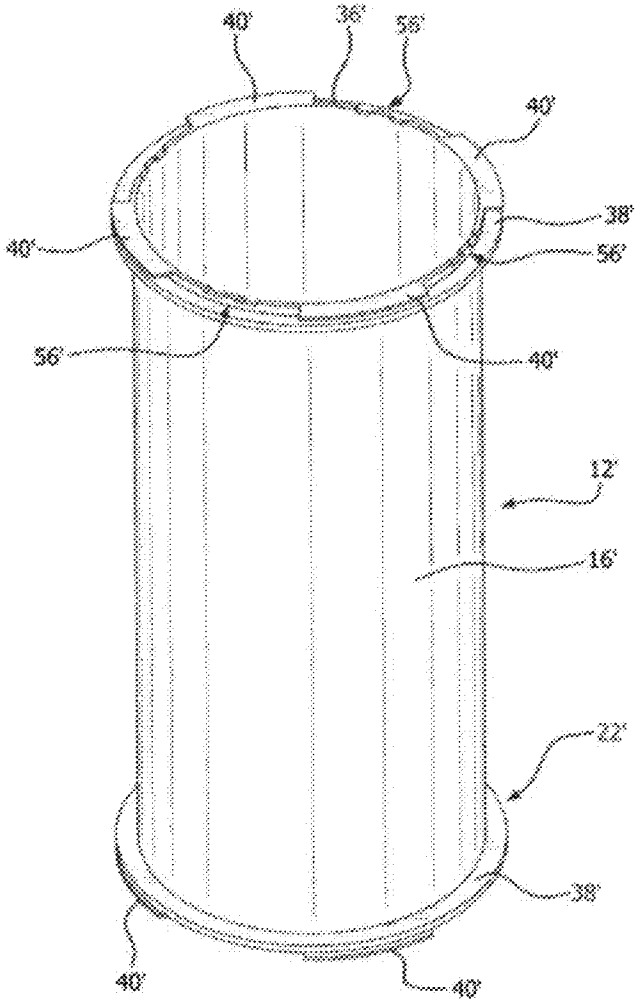
FIGS. 7A-7B show perspective views of embodiments of a barrel portion of a spool.
Figure 7B:
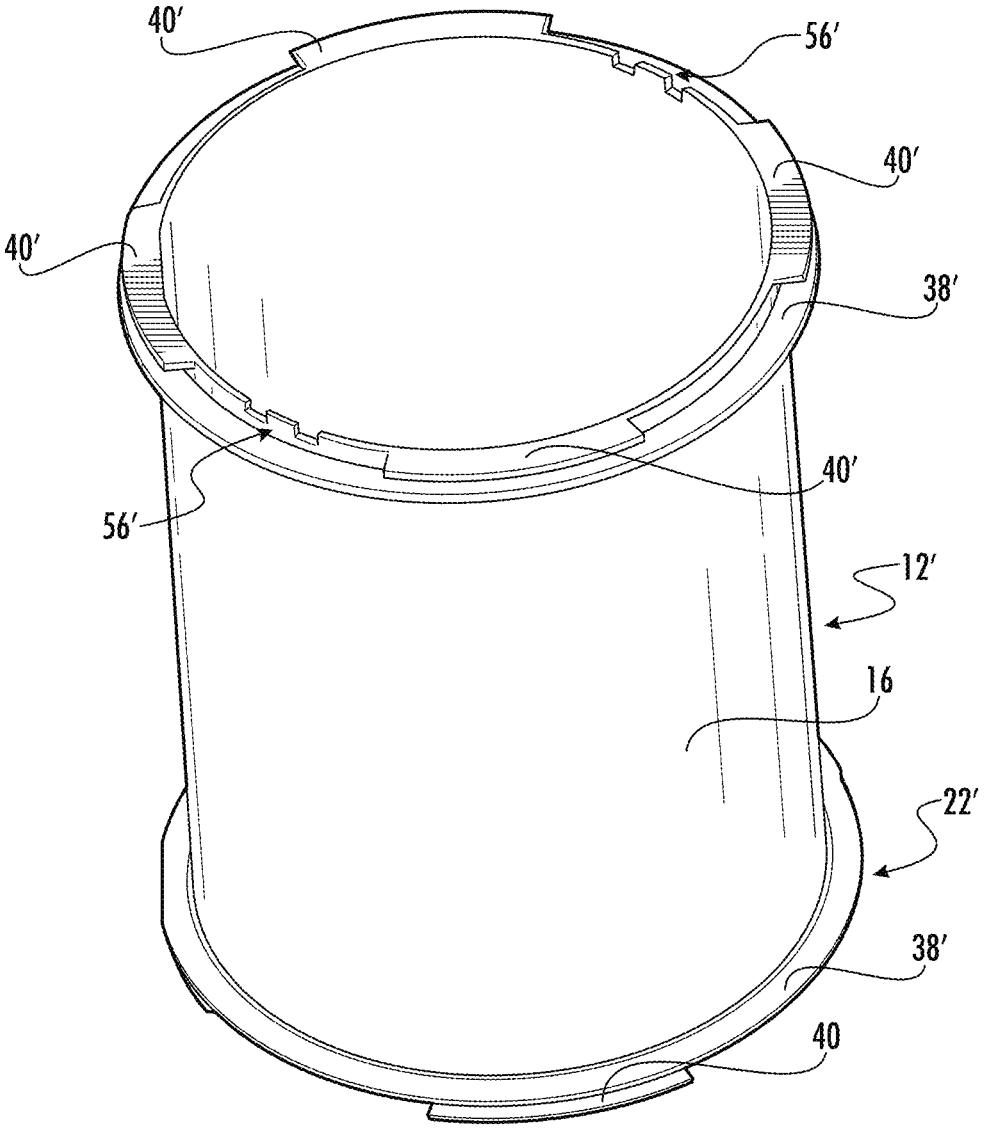

In FIG. 6, the tab 48 is shown in cross section with the head portion 52 engaged within a notch 56 formed on the bottom surface of a foot 40 on the end of the barrel 12. The notch 56 is contemplated to have defined sidewalls (not shown) such that the tab head 52 is engaged on all sides. The engagement of the head 52 of the tab 48 within the notch 56 on the foot portion 40, resulting from the spring force of the tab 48 and the shape of the head portion 52 and notch 56, preferably resists rotational movement between the barrel 12 and the flange 14.

As shown in FIG. 6, a radially inward protrusion or flange tab 58 is formed on the outer wall 32 of the receiving channel 26. The flange tab 58 fits within the space 50 (see also FIG. 4) between the ring 38 and the foot 40 on the axial end 36 of the barrel 12. The combination of foot 40 and tab 58 forms a part of an optional locking mechanism for the barrel 12 and the flange 14. The overlap of the foot 40 with the tab member 58 of the insertion section 22 within the channel 26 axially secures the barrel 12 with the flange 14.

As shown in the exploded view of FIG. 2, a number of inwardly directed tabs 58 are formed within the channel 26. The tabs 58 are contemplated to be equidistantly spaced around the outer wall 32 in the channel 26. The barrel 12 is provided with a corresponding number of feet 40 that are also spaced around the perimeter of the axial end 36 of the barrel. The spacing is contemplated to permit the barrel insertion section 22 to be axially inserted into the channel 26, with the tabs 58 and feet 40 alternating within the channel 26. In this embodiment, a radial rotation of the barrel 12 relative to the flange 14 causes each individual foot 40 to move under a corresponding tab 58 to axial lock the flange 14 to the barrel 12. The surfaces of the tabs 58 and feet 40 may be sized and formed to create a frictional engagement as part of the overlapping relationship. This frictional locking of the tabs 58 within the engagement space 50 further secure the barrel 12 and flange 14 together, resisting a radial rotation of the parts. In an embodiment, the fixing means formed by the flexible tab 48 engagement with the notch 56 in the foot 40 further secures the radial position of the barrel 12 within the channel 26 of the flange 14. In an embodiment, a single locking tab 48 is provided on the flange 12 and is positioned within the area of the receiving channel 26 between two of the inwardly directed tabs 58.

The above-noted locking mechanism between the flange 14 and the barrel is preferably releasable. The flexibility of the tab 48 permits the head portion 52 to move away from its engagement position within the notch 56, allowing the relative rotation of the flange 14 and the barrel 12, until the rotation causes the feet 40 to move into the area adjacent the spaced tabs 58 within the channel 26. Once the barrel feet 40 are no longer overlapping with the tabs 58, the insertion end 22 of the barrel 12 may be axially withdrawn from the channel 26 and separated from the flange 14.

The spool 10 as illustrated and described is an efficient assembly of two to three pieces and creates a bond between the barrel 12 and the flange(s) 14 that is strong enough to meet or exceed industry strength requirements. The assembly is created by rotating the barrel 12 relative to the flange(s) 14. In this embodiment, the two parts are further locked into place by the engagement of the elements of the barrel insertion section 22 and the structures within the receiving channel 26. The locking tab 48 engagement of the barrel axial end 36 may further be released for breakdown of the spool elements. Movement of the tab 48 is dependent on the flexibility of the tab. In an embodiment, disassembly may include the breaking of the tab to permit rotation and release. Due to at least this possibility, in an embodiment described below, a locking tab 48 may be utilized in combination with a sliding lock in a flange 14.

The corner defined by intersection of the winding surface of the barrel and the support surface of the flange often creates a stress concentration within known spool constructions. The stress due to normal use (and disuse) may further cause unintended failure of the assembly (or molded parts). Material fatigue in the area of the barrel/flange intersection may result in damage to the material wound on the spool or cause a snag in the winding (and unwinding) operation. In the embodiments shown, a fillet is provided at the intersection of the ring 38 and the winding surface 16 of the barrel 12. The radial extension of the ring 30 forms a start-up for the flange support surface 20 and separates the stress, which may be caused by deflection of the flange 14, from the intersection with the barrel wall 14. The angle 44 of the outer wall 32 may also serve to diminish stress concentrations. The support of the end 60 of the ring 38 by the receiving surface 62 on the flange serves to diminish stress on the ring 38. Further, the dimensional relationships of the engagement of the insertion section 22 of the barrel 12 with the receiving channel 26 of the flange preferably fix the barrel and flange to form a relatively rigid spool construction.

In FIGS. 7-11, there is shown a barrel and flange combination having some different structural features from those shown in the prior figures. In FIGS. 7A and 7B, a barrel 12' is shown having a cylindrical winding surface 16' and an insertion section 22' on each end. The insertion section 22' is defined by an annular ring 38 spaced from an axial end 36' of the barrel 12' and a plurality of projection feet 40 around the perimeter of the axial end 36'. On the axial end 36' of the barrel, between some or all of the adjacent feet 40', is provided a plurality of engagement means 56'. As more particularly shown in FIG. 8, the engagement means 56' is formed by a projection 64 positioned between two barrel detents 66 within the axial end 36' of the barrel 12'. The engagement means 56' engages with additional structures on the flange (see FIGS. 9-11, discussed below) to fix the radial position of the barrel 12', when locked to the flange. In some embodiments, two engagement means 56' may be disposed on the axial end 36' of the barrel (FIG. 7B). In other embodiments, one or four engagement means 56' may be disposed on the axial end 36' of the barrel (FIG. 7A).

Figure 8:
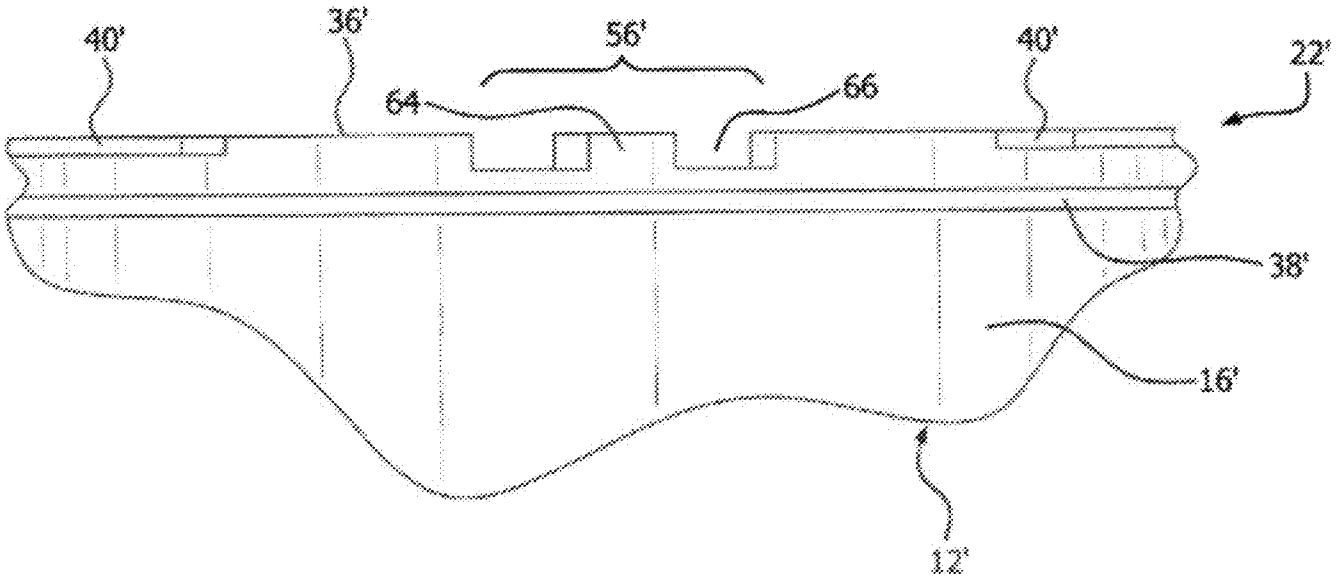
FIG. 8 shows an enlarged elevation view of a portion of an end of the barrel shown in FIG. 7.
Figure 9:
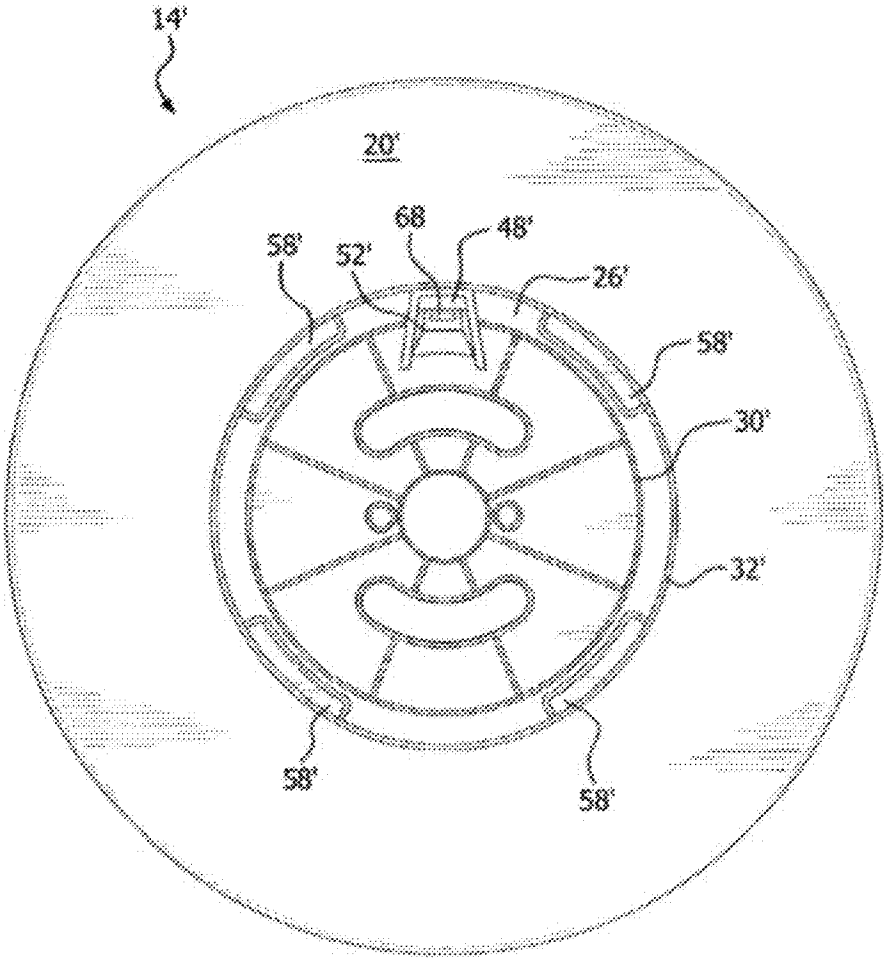
FIG. 9 shows a plan view of an embodiment of a flange portion of a spool, the flange contemplated to mate with the barrel shown in FIGS. 7 and 8.

In FIG. 9, there is shown one face of a flange 14' having a support surface 20' surrounding a receiving channel 26' for the insertion section 22' of the barrel 12' of FIGS. 7 and 8. The receiving channel 26' is similar to that of FIGS. 1-6, having an inner support wall 30', an outer wall 32 and a plurality of inwardly projecting tabs 58' spaced around the defined channel 26'. In this embodiment, a flexible tab 48' is defined in the flange 14' and is positioned between two locking tabs 58'. The head 52' of the flexible tab 48' includes an opening 68 formed to engage a projection 64 on the axial end 36' of the barrel 12'.

Figure 10:
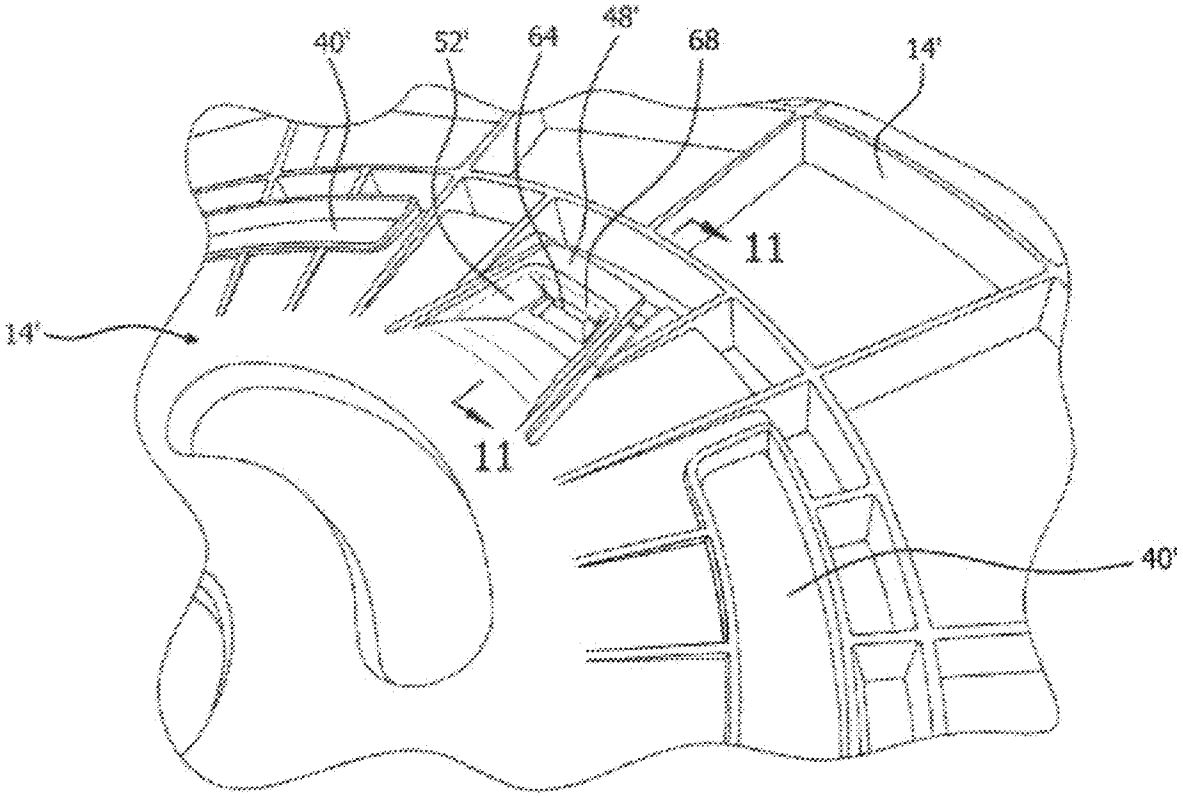
FIG. 10 shows a partial perspective view of the flange shown in FIG. 9.

In FIG. 10, a portion of the flange 14' is shown engaged with an end of the barrel 12' of FIGS. 7 and 8. The flexible tab 48' includes an opening 68 and is aligned within the receiving channel 26' in the space between two of the inwardly projecting tabs 58'. As the barrel end (36') is rotated within the receiving channel 26', the feet 40' rotate into the space between the bottom of the channel 26' and the inwardly projecting tabs 58'. The overlap of the feet 40' and the inward projections 58' within the channel serve as an axial locking mechanism for the barrel 12' and flange 14'. In the view of FIG. 10, two of the feet 40' are shown within openings formed in the body of the flange 14'. Further locking of the barrel 12' and flange 14' occurs during the relative rotation of the barrel 12' and flange 14'. One of the projections 64 on the axial end 36' of the barrel 12' (FIGS. 7 and 8) moves into contact with the flexible tab 48'. The flexible tab 48' flexes to permit the projection 64 to move into alignment with the opening 68. Once aligned, the projection 64 is engaged within the opening 68 and the radial position of the barrel 12' and the flange 14' is fixed.

Figure 11:
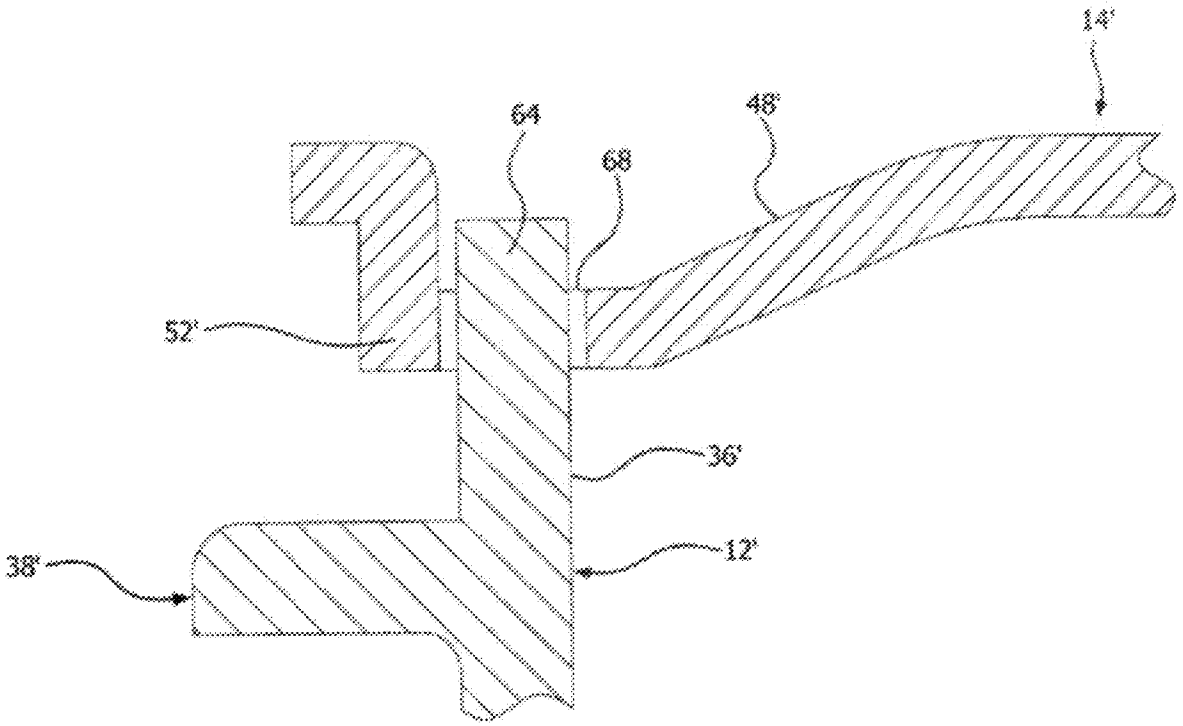
FIG. 11 shows a cross sectional view of a portion of the flange of FIGS. 8 and 9, as taken along line 11-11.

The engagement of the flexible tab 48' on the flange 14' with the projection 64 on the axial end 36' of the barrel 12' is shown in FIG. 11. The two barrel detents 66 (see FIG. 8) permit the tab 48' to flex to its normal position, once the projection 64 is positioned within the opening 68 on the end of the tab 48'. The ring 38' is spaced from the flexible tab 48'. Although there are some differences in structure in the present embodiment, the end of the ring 38' is contemplated to engage and align flush with the support surface of the flange in the manner shown in FIGS. 4 and 6. In addition, in the present embodiment a fillet is shown at the intersection of the ring 38' and the barrel wall, as is also discussed above.

Figure 12:
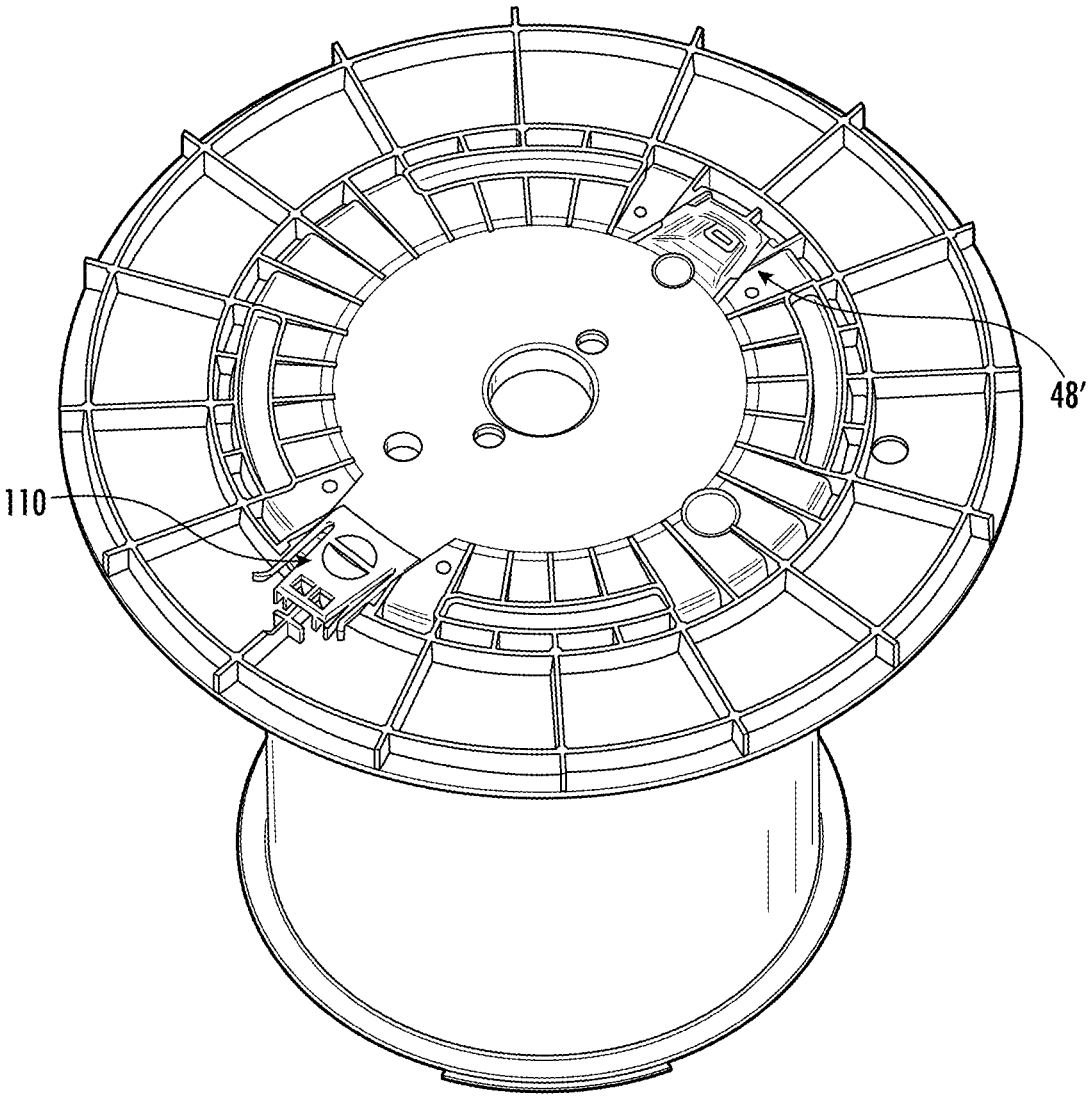
FIG. 12 shows a perspective view of a flange and barrel with a sliding lock system in an embodiment of the invention.

In the invention, the locking tab 48 and/or the flexible tab 48' described above may be substituted with or may be utilized in addition to a sliding lock system 100. For example, in an embodiment, the spool of the present invention may comprise a locking tab 48 and/or a flexible tab 48' in a first position of a flange 14 and a sliding lock system 100 in a second position of the flange 14, as shown in FIG. 12 (illustrating the flexible tab 48' and the sliding lock 110). The first and second positions may be opposite one another with respect to a central axis of the barrel 12 and/or center of the flange 14. In this embodiment, the flexible tab 48' may be more flexible than would ordinarily be required without use of a sliding lock 110 because the sliding lock system 100 will receive much of the torque load during rotation.

In this embodiment, the flexible tab 48' may additionally serve as a flange-to-barrel alignment feature. That is, upon rotation, one of the projections 64 on the axial end 36' of the barrel 12' moves into contact with the flexible tab 48'. The flexible tab 48' flexes to permit the projection 64 to move into alignment with the opening 68. Once aligned, the projection 64 is engaged within the opening 68 and the radial position of the barrel 12' and the flange 14' is fixed. Once aligned, the sliding lock 110, described below, may be inserted.

As noted above, the locking tab 48 and/or the flexible tab 48' may be used in connection with a sliding lock system 100. One or more locking tabs and/or flexible tabs 48' may be disposed on a flange which also comprises one or more sliding lock systems. Alternatively, the locking tab 48 and/or the flexible tab 48' may be eliminated altogether and a single sliding lock system 100 or two or more sliding lock systems 100 may be disposed on the flange 14.

In an embodiment, the sliding lock 110 is completely removable from the flange 14 and/or barrel 12. Thus, if the sliding lock 110 is damaged or destroyed, the sliding lock 110 may be inexpensively replaced without replacement of the entire flange 14. In this embodiment, a flange 14 which comprises a sliding lock system 100 may continue to be used even if an integral locking tab 48 and/or the flexible tab 48' becomes damaged or destroyed. In an embodiment shown in FIG. 13A-13B, the sliding lock system 100 may have a locked position (FIG. 13A) and an unlocked position (FIG. 13B). The sliding lock 110 is slidable between the locked and unlocked position.

In an embodiment, the sliding lock 110 simultaneously engages with the flange 14 and the barrel 12. In an embodiment, at least one sliding lock 110 is positioned on the flange 14 approximately adjacent the aligned axial end portion 36 of the barrel 12. If two or more sliding locks 110 are utilized, they may be positioned about the circumference of the flange 14 approximately adjacent the aligned axial end portion 36 of the barrel 12. In the locked position, the sliding lock 110 prevents the flange 14 from rotating on the barrel 12 and also prevents disassembly of the spool 10. In the unlocked position, the sliding lock 110 is disengaged from the barrel 12 (and optionally the flange 14) and the spool 10 may be disassembled.

Figure 14A:
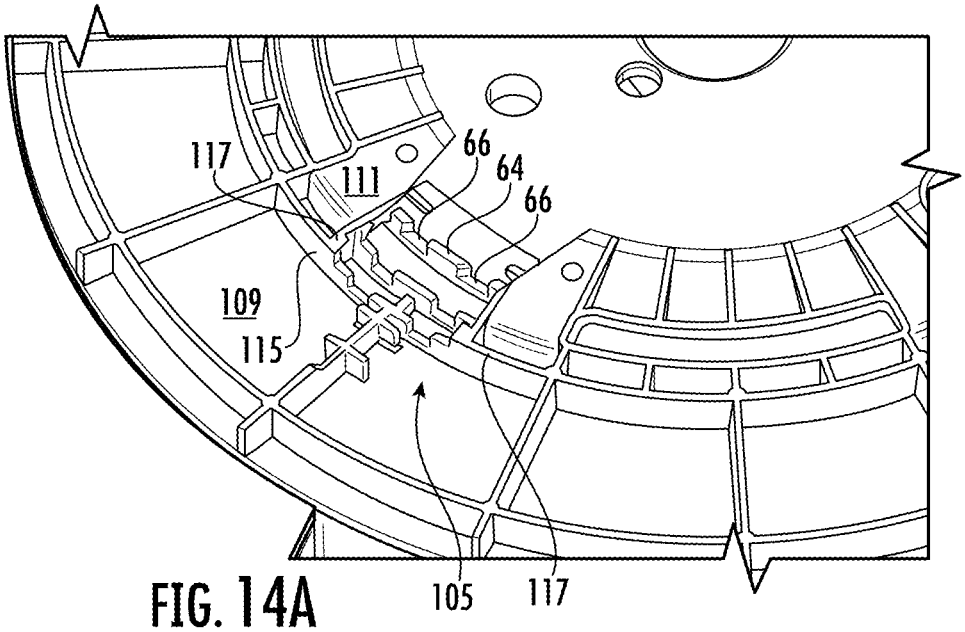
FIGS. 14A-14B show a close-up view of a sliding lock system in an embodiment of the invention.
Figure 14B:
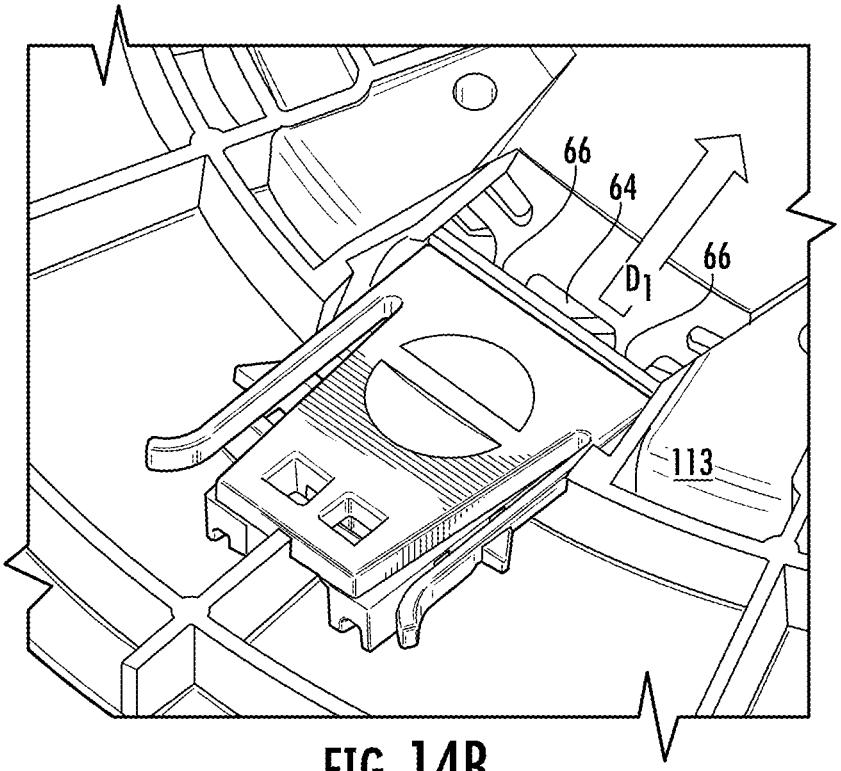
Figure 15:
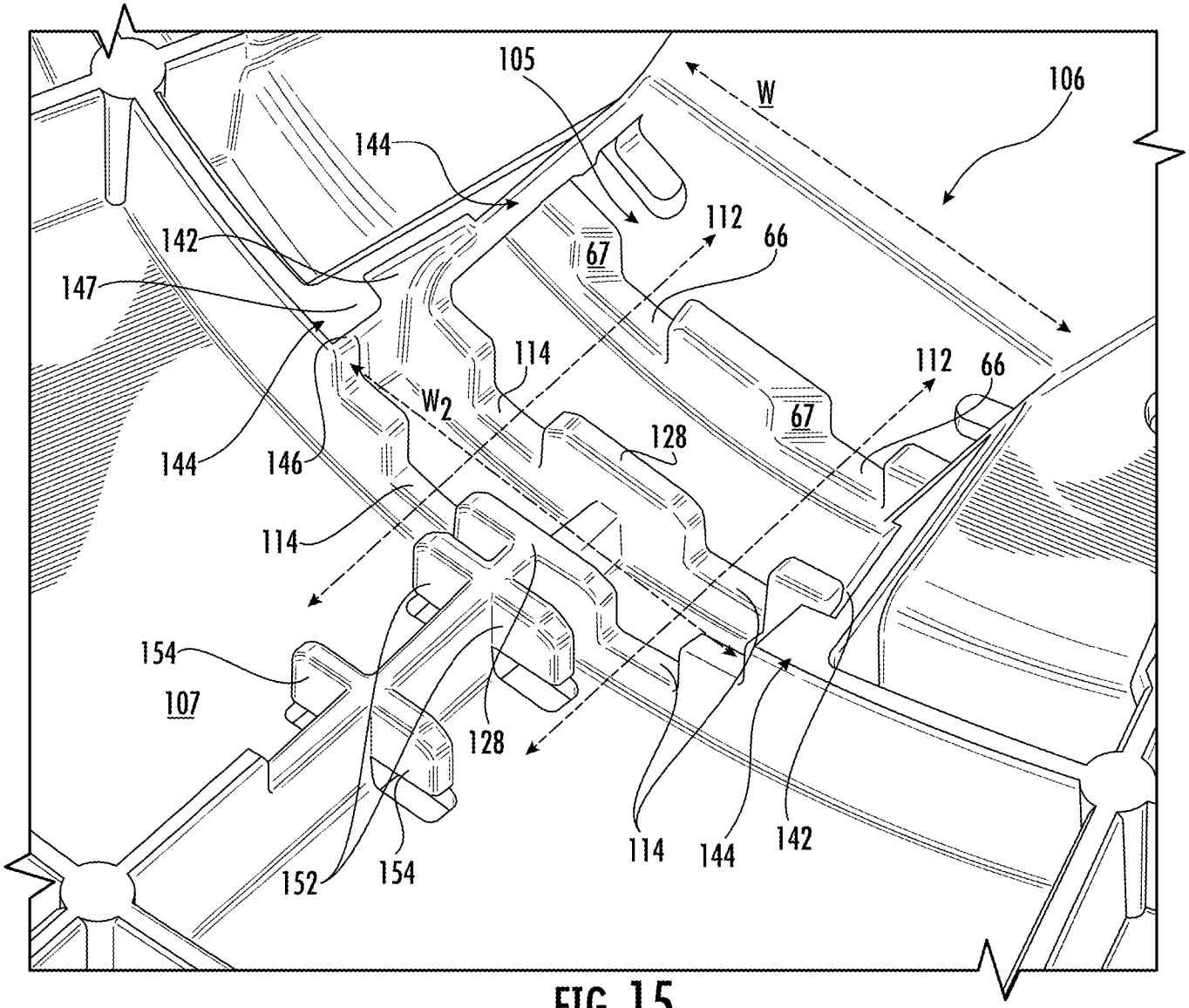
FIG. 15 shows a close-up view of a flange and barrel in an embodiment of the invention.

FIG. 14A illustrates a view of the aligned flange 14 and barrel 12 without the sliding lock 110 in place. FIG. 14B illustrates the aligned flange 14 and barrel 12 with the sliding lock 110 in its unlocked position. FIG. 15 illustrates an exploded view of the flange 14 receiving location 105 for the sliding lock 110. The receiving location 105 may have a proximate end 106 (nearer the center of the flange 14 and central axis 18 of the barrel), a distal end 107 (nearer the outer circumference of the flange 14), and a width W. The receiving location 105 may comprise an opening in the flange 14 wherein at least the engagement means 56 (more particularly the projection 64 and the barrel detents 66) of the barrel 12 is visible. The opening may aid in alignment of the barrel 12 and flange 14.

As can be seen in FIG. 15, when the flange 14 and barrel 12 are aligned, at least one track 112 is created between the barrel detents 66 (within engagement means 56 of the barrel 12) and the flange detents 114. In an embodiment, two parallel tracks 112 are created. However, the invention is not so limited and three, four, or any number or tracks 112 are contemplated. In an embodiment, the receiving location 105 of the flange 14 has a pair of concentric flange detents 114, as shown in FIGS. 14-15, one pair of flange detents 114 being located circumferentially outward of the other pair of flange detents 114. Any number of concentric flange detents 114 may be used. That being said, the receiving location 105 of the flange 14 may comprise only one flange detent 114 or only one pair of flange detents 114 in other embodiments. Likewise, the barrel 12 may comprise any number of concentric barrel detents 66. A plurality of concentric flange detents 114 or barrel detents 66 may increase the strength of the sliding lock system 100 and, thereby, the load capacity of the spool 10. The number of flange detents 114 positioned about the circumference of the flange 14 in each receiving location 105 (not counting concentric detents) should correspond to the number of barrel detents 66 in an engagement means 56 of the barrel 12, in an embodiment. For example, if two barrel detents 66 are utilized, two flange detents 114 should be utilized, creating two tracks 112.

The receiving location 105 may be disposed in an offset portion 111 of the flange 14 which is elevated above a circumferential portion 109 of the flange (see FIG. 14A). In such an embodiment, a sidewall 113 (FIG. 14B) may connect the offset portion 111 and the circumferential portion 109 of the flange 14. The receiving location 105 may be disposed in the offset portion 111 and the sidewall 113. The flange detents 114, for example, may be disposed in the sidewall 113. Further, one or more circumferential ribs 115 may be disposed radially outward of the sidewall 113 and concentric flange detents 114 may be disposed in said circumferential ribs 115.

In an embodiment, the flange detents 114 may be separated by one or more flange projections 128 (see FIG. 15). The flange projections 128 may have a depth dimension. The flange projections 128 may be flush with or approximately flush with the offset portion 111 of the flange 14, in an embodiment. The flange detents 114 may extend into the sidewall 113 of the flange 14, in an embodiment. In an embodiment, the depth of the flange detents 114 is the same as or is approximately the same as the depth of the barrel detents 66. In an embodiment, the width of the flange detents 114 is the same as or is approximately the same as the width of the barrel detents 66.

In an embodiment, the barrel detents 66 are angled such that the sidewalls 67 of the barrel detents 66 direct inwardly. That is, the outer face of a barrel detent 66 (with reference to the interior and exterior of the barrel 12) may be wider than the inner face of the barrel detent 66. As will be understood herein, this configuration may direct the rails of the sliding lock 110 into the correct alignment. Any angle known in the art may be utilized in this embodiment. Likewise, in some embodiments, no such angle may be necessary. For example, FIG. 23 illustrates barrel detents 66 which are formed at right angles which correspond to the size of the rails 134.

Figure 16A:
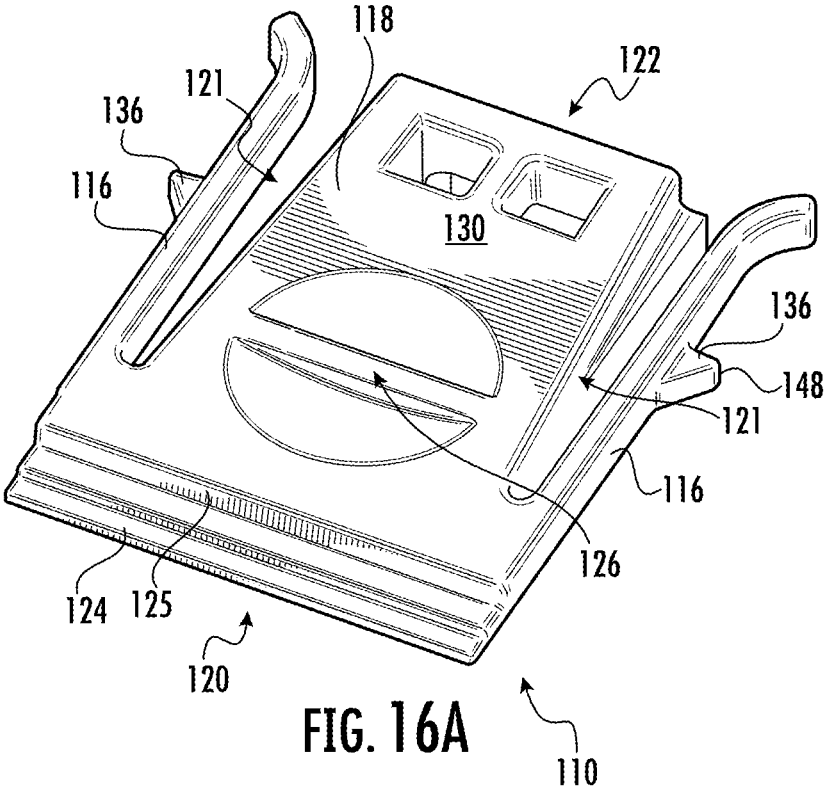
FIGS. 16A-16D show a sliding lock system in an embodiment of the invention.
Figure 16B:
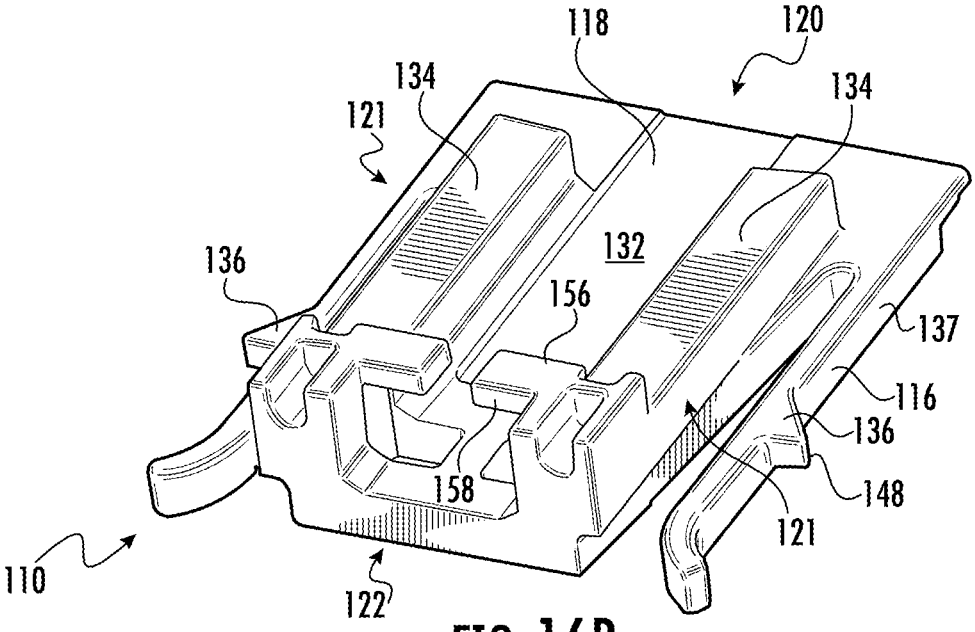
Figure 16C:
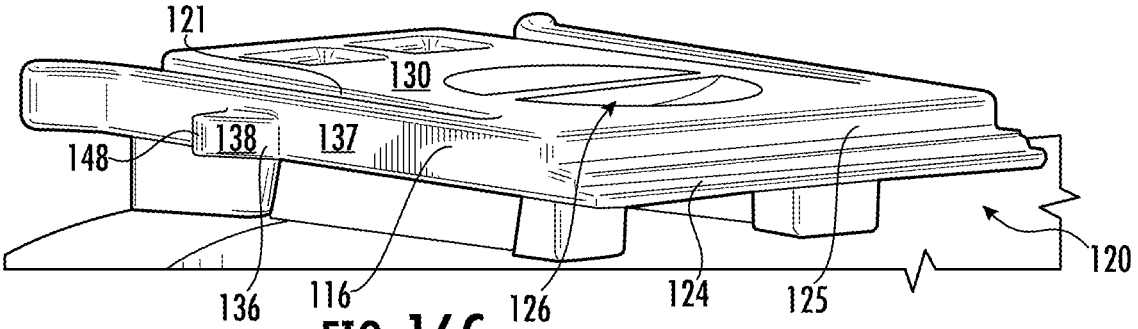
Figure 16D:
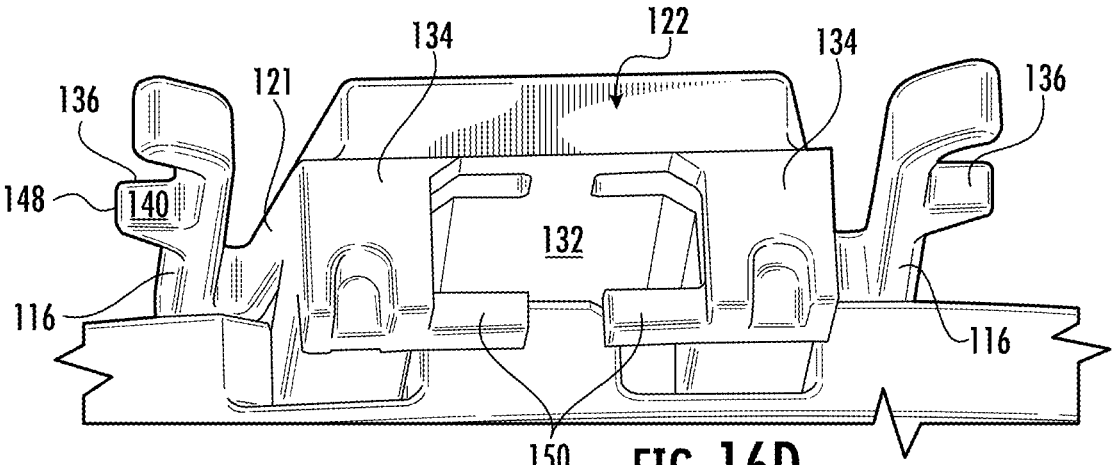

FIGS. 16A-16B illustrate the sliding lock 110 in a top view (FIG. 16A) and a bottom view (FIG. 16B). The sliding lock 110 comprises, in an embodiment, a central body portion 118 and at least one arm 116, preferably two arms 116. The body portion 118 may be generally square, rectangular, ovular, elliptical, or may have an irregular shape. The width of the body portion 118 may generally correspond to the width of the receiving location 105 in the flange 14 for the sliding lock 110. The body portion 118 may comprise a proximate end 120, a distal end 122, and two sides 121, wherein the proximate end 120 is closer to the central axis 18 of the barrel 12 when engaged and the distal end 122 is further from the central axis 18 of the barrel 12 when engaged. In an embodiment, the proximate end 120 of the sliding lock 110 comprises a lip 124 which has a reduced thickness as compared to the body portion 118. The lip 124 may be designed to engage with an edge 65 of the offset portion 111 of the flange 14 within the receiving location 105 (see FIG. 14A-14B). In this embodiment, the lip 124 may slide under the edge 65 of the offset portion 111 of the flange 14 to secure the sliding lock 110 in place. In an embodiment, the portion of the sliding lock 110 which contacts the edge 65 of the offset portion 111 of the flange 14 may be a flattened rim 125. The rim 125 may stop upon contact with the edge 65 of the offset portion 111 of the flange 14. In an embodiment, the lip 124 may have a plurality of reduced thicknesses or may gradually become thinner as it moves away from the body portion 118 toward the proximate end 118.

Figure 21:
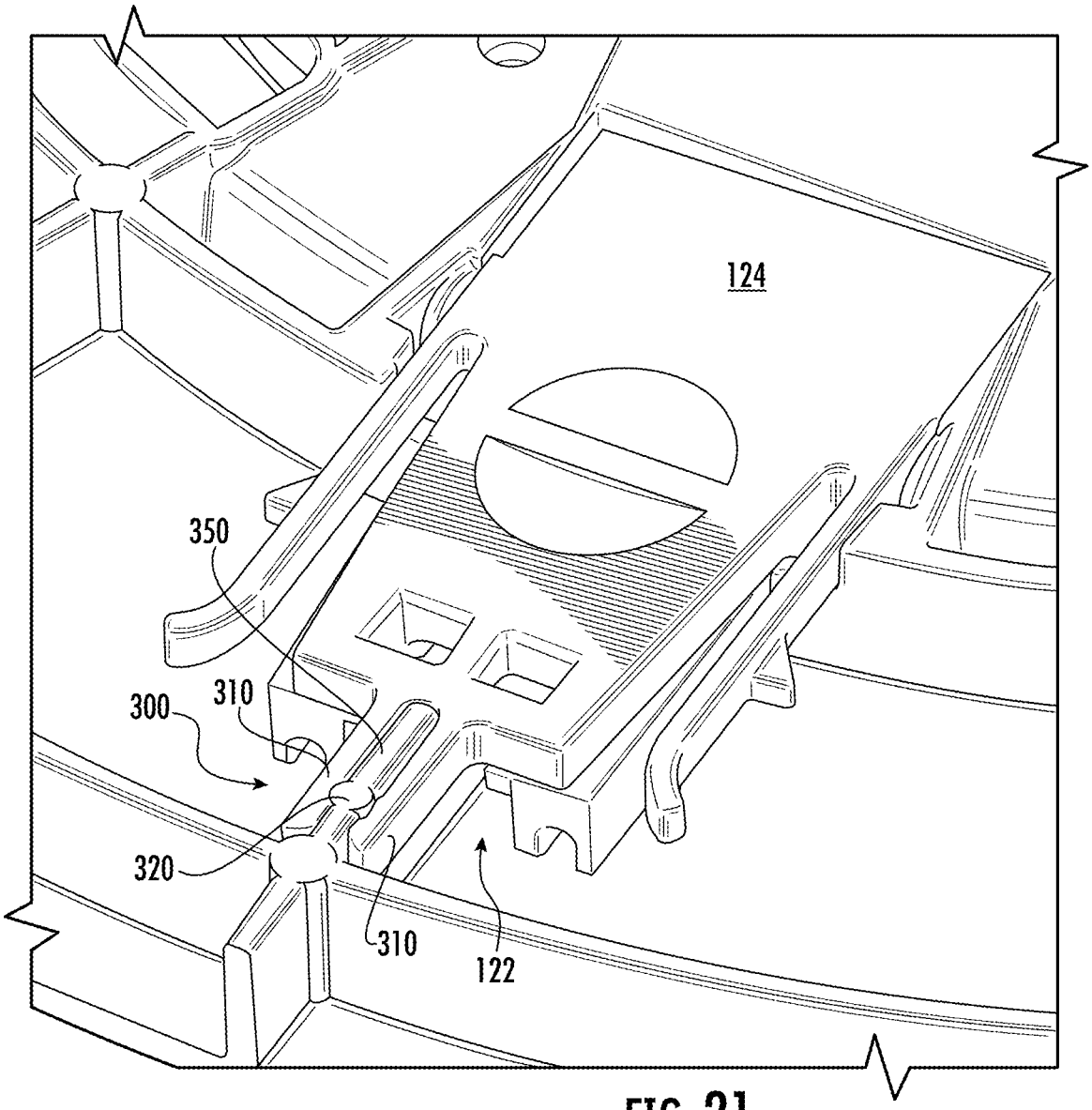
FIG. 21 illustrates the sliding lock of FIG. 20 in an unlocked configuration in an embodiment of the invention.
Figure 22A:
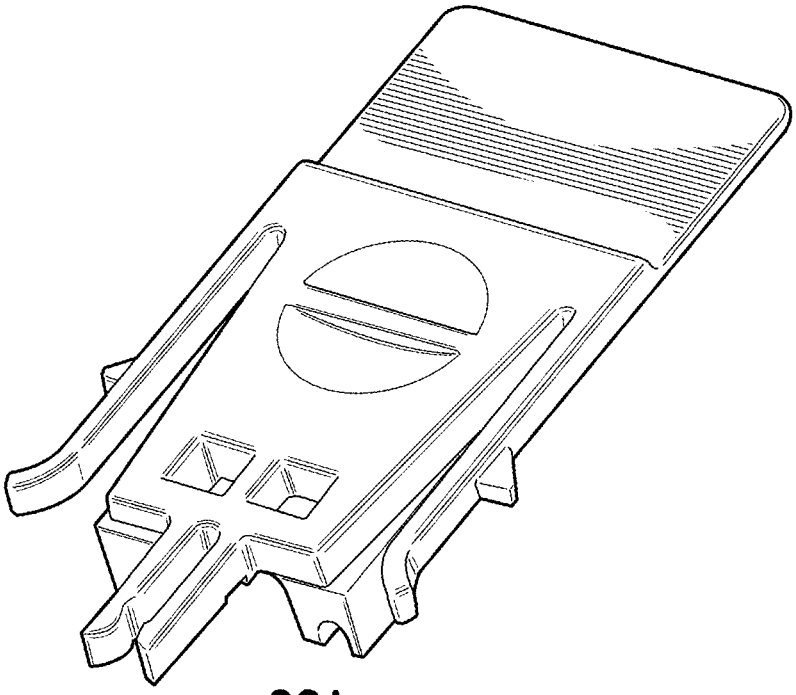
Figure 22B:
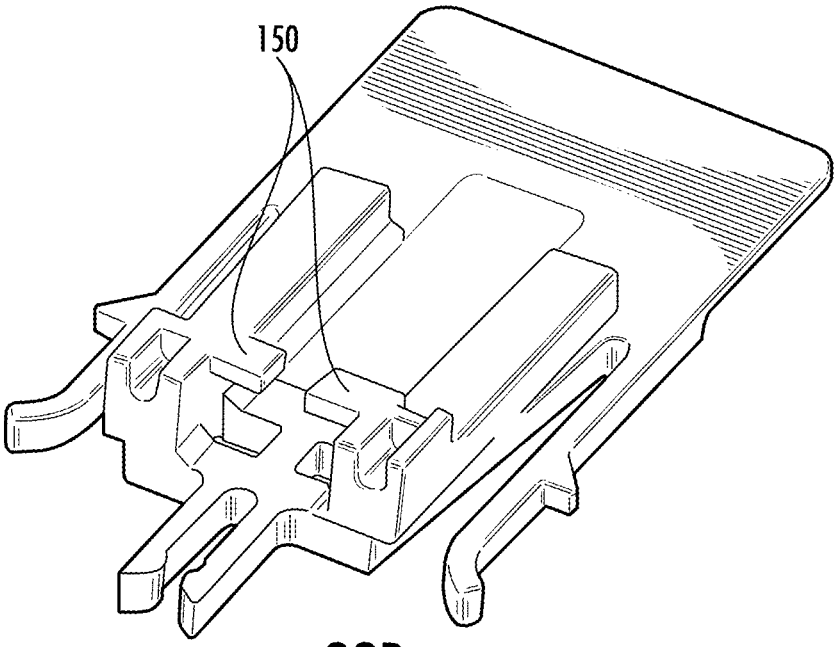
Figure 22C:
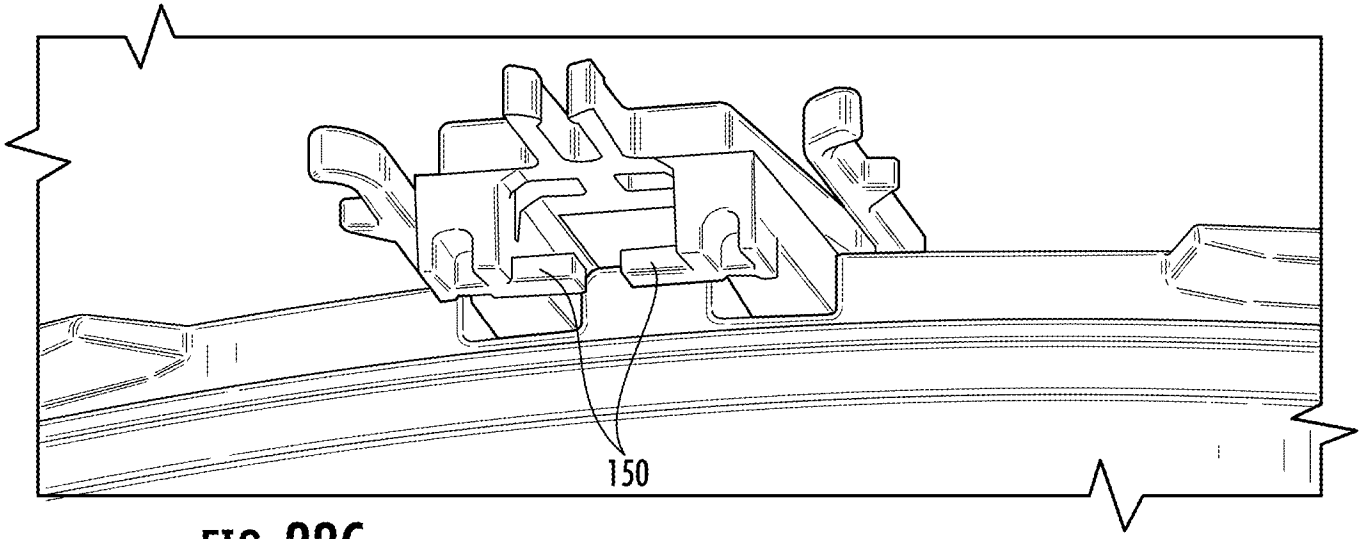
Figure 22D:
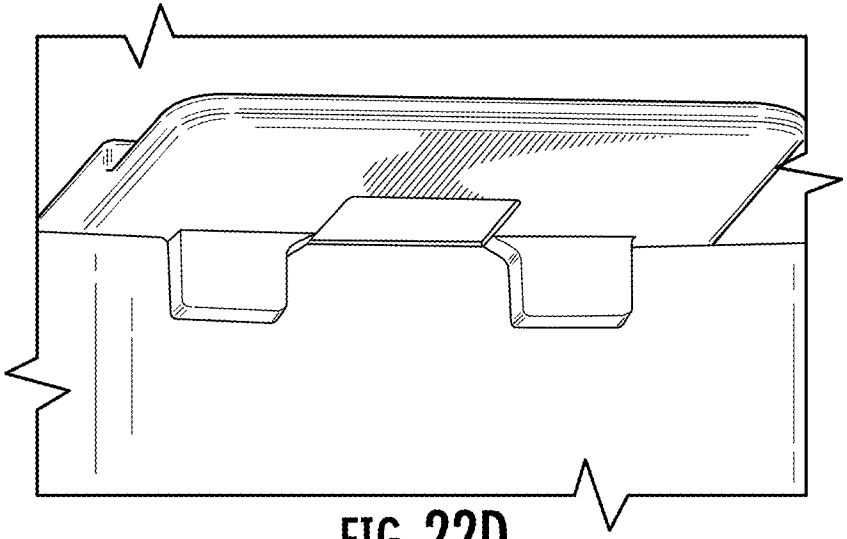

FIG. 21 illustrates an embodiment wherein the lip 124 has an increased length, such that it secures the sliding lock 110 against the flange over a larger surface area. In this embodiment, the lip 124 may engage the flange in the locked and the unlocked positions. See FIGS. 20-21. As shown, the extended lip 124 engages the underside of the flange in both the locked and the unlocked positions.

In this embodiment, the sliding lock 110 may be inserted into the flange receiving location 105 at an angle or in a tilted position (see FIG. 28-29), with the lip 124 inserted first and the body portion 130 angled or tilted as compared to the flange surface. Once the lip 124 is engaged with the flange, the body portion 130 of the sliding lock 110 may then be moved into a position which is parallel to or adjacent the surface of the flange. Likewise, to remove the sliding lock 110 from the flange, the sliding lock must be moved into an angled position to remove the elongated lip 124 from the receiving location 105.

In an embodiment, the sliding lock 110 may have an outer surface 130, designed to face outwardly, away from the spool 10, and an inner surface 132, designed to face inwardly, toward the flange 14 and barrel 12, when the sliding lock 110 is engaged. In an embodiment, the inner surface 132 of the sliding lock 110 comprises at least one rail 134. In a particular embodiment, the inner surface 132 of the sliding lock 110 comprises at least two rails 134. The rails 134 may be elongated three-dimensional elements which correspond to the shape and size of the flange detents 114 and barrel detents 66 of the barrel engagement means 56. For example, the flange detents 114 and barrel detents 66 may be generally square or rectangular and the rails 134 may comprise rectangular prisms. Likewise, the flange detents 114 and barrel detents 66 may be generally triangular and the rails 134 may comprise elongated triangular pyramids. In use, the rails 134 slide into and through the track 112 created by the flange detents 114 and barrel detents 66. This rail/track connection, once the sliding lock 110 is fully engaged and locked, prevents rotation of the flange 14 separately from the barrel 12. In an embodiment, the rails 134 may initiate near the proximate end 120 of the sliding lock. In an embodiment, the rails 134 may initiate at or near the location of the rim 125 of the sliding lock 110, but on the inner surface 132 of the body 118. In an embodiment, the rails 134 may extend along the length of the sliding lock 110 and may terminate at or near the distal end 122 of the sliding lock. In an embodiment, the rails 134 extend elongate on the body portion 118, along the sides 121 of the sliding lock.

In an embodiment, the body portion 118 may comprise a finger hold 126. In this embodiment, the finger hold 126 may comprise any feature or texture which allows a user to more easily grip, hold, move, or place the sliding lock 110 into position (engage or disengage). In an embodiment, the finger hold 126 comprises a generally concave divot with a raised central portion that may be gripped between a finger and a thumb, for example. The finger hold 126 may allow a user to push or pull the sliding lock 110 along the rails 134 and track 112 or may allow a user to move the sliding lock 110 in and out of position, for use and storage.

In an embodiment, each arm 116 of the sliding lock 110 may initiate along an opposite side 121 of the proximate end 120 of the sliding lock 110 and extend along each side 121 of the body portion 118, toward the distal end 122. Each arm 116 may connect to the body portion at the proximate end 120, but may be separated from the body portion 118 along each side 121 of the body portion. Each arm 116 may have flexibility such that it is biased toward an initial extended position (shown in FIG. 16A-16B), but can be moved toward a compressed position by applying pressure to the arm in the direction of the body portion 118. In an embodiment, each arm 116 may terminate at or near the distal end 122 of the sliding lock 110. The end of each arm 116 may curve away from the body portion 118, in an embodiment. Any shape or configuration which may be adapted to receive finger pressure may be presented, however. In an embodiment, the arms 116 may be repeatedly compressed using external force (finger pressure) and may extend to their biased position upon release of the external force. In an embodiment, the pressure required to compress the arms 116 may be determined based upon the angles between the body portion 118 and the arms 116, the thickness of the arms, and like factors. Such may be determined on a case-by-case basis depending on the weight of the material to be wound or like factors.

In an embodiment, each arm 116 may have a catch 136. The catch 136 may be disposed on the interior surface (facing toward the body 118) or exterior surface 137 (facing away from the body 118) of the arm 116. The catch 136 may comprise any mechanism that allows movement of the sliding lock 110 in one direction (first direction $D_1$ (see FIG. 14B)), but prevents movement of the sliding lock 110 (without application of exterior force) in the opposite direction (a second direction $D_2$ (see FIG. 14A)). For example, the catch 136 may comprise a generally triangular feature. In an embodiment, the catch 136 may comprise a right triangle which allows movement of the sliding lock 110 such that the angled portion 138 (i.e. the hypotenuse) does not prevent movement in the first direction $D_1$ and, once locked, the flattened base portion 140 (i.e. the leg) restricts or prevents movement in the second direction $D_2$. In an embodiment, the catch 136 is positioned on the arm 116 approximately midway between the distal end 122 of the sliding lock 110 and the proximate end 120 of the sliding lock 110. In an embodiment, the catch 136 is formed integrally with the sliding lock 110.

Figure 13A:
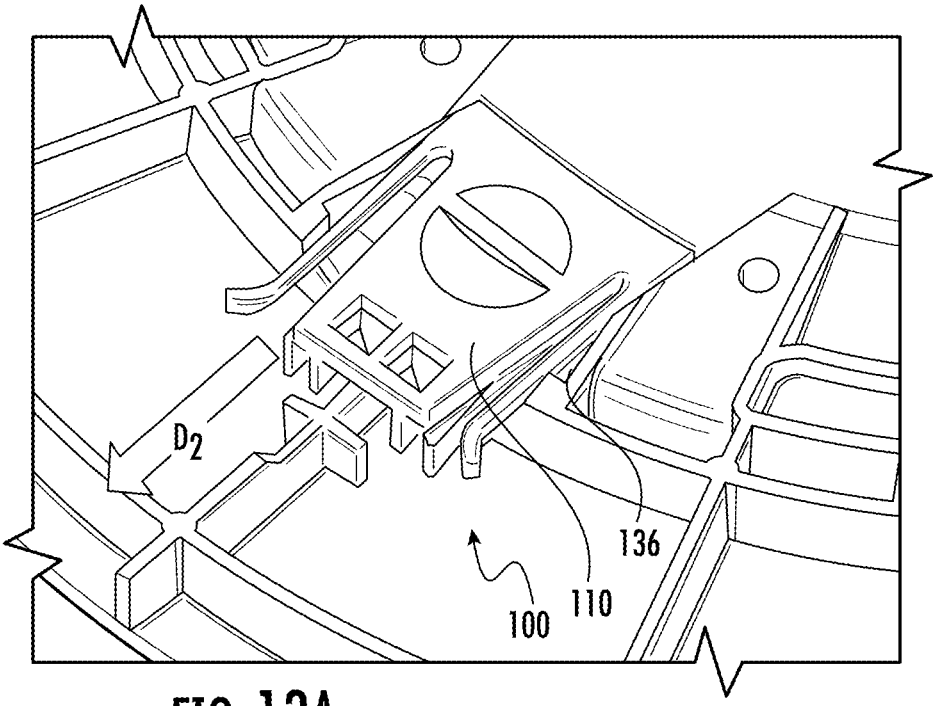
FIGS. 13A-13B show a close-up view of a sliding lock system in an embodiment of the invention.
Figure 13B:
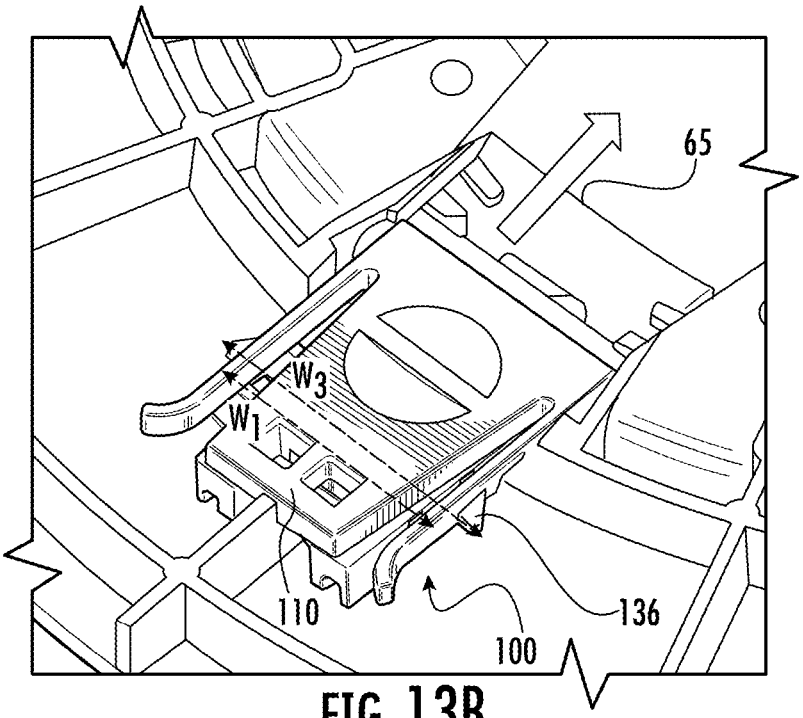

Referring to FIGS. 13A-13B and 15, the flange 14 may comprise a recessed portion 142 along the sidewall 144 of the receiving location 105. The recessed portion 142 may comprise any size or shape known in the art, but is designed to receive the catch 136. Thus, the recessed portion 142 may comprise a recessed square, rectangle, or triangle, in an embodiment. The distal wall 146 (positioned furthest from the center of the flange 14) of the recessed portion 142 may be sized and configured to match the size and configuration of the flattened portion 140 of the catch 136. In an embodiment, a portion of sidewall 144 is positioned radially outward of the recessed portion 142. In an embodiment, the distal wall 146 is perpendicular or approximately perpendicular to that of the sidewall 144. In an embodiment, the width $W_1$ of the arms 116 may be greater than the width $W_2$ between each portion of sidewall 144 that is positioned radially outward of the recessed portion 142 (see FIGS. 13B and 15). In an embodiment, the width $W_3$ of the catches 136 may be greater than the width $W_2$ between each portion of sidewall 144 that is positioned radially outward of the recessed portion 142 (see FIGS. 13B and 15).

In an embodiment, the recessed portion 142 may be disposed within a perpendicular rib 117 which connects the circumferential rib 115 to the offset portion 111 of the flange 14. The recessed portion 142 may extend into perpendicular rib 117 and away from the flange detents 114. In an embodiment, the perpendicular rib 117 may comprise the sidewall 144.

In operation, the sliding lock 110 may be positioned as set forth in FIG. 13B, with the rails 134 in the tracks 112 and manually pushed toward the center of the flange 14, through the track 112. If the width $W_1$ of the arms 116 is greater than the width $W_2$ between each portion of sidewall 144 that is positioned radially outward of the recessed portion 142, the arms 116 must flex inwardly to move through this space. Likewise, if the width $W_3$ of the catches 136 is greater than the width $W_2$ between each portion of sidewall 144 that is positioned radially outward of the recessed portion 142, the arms 116 must flex inwardly to move through this space. The angled portion 138 of the catches 136 should allow the catches 136 to slide against the portion of sidewall 144 that is positioned radially outward of the recessed portion 142 while the arms 116 flex inwardly. This inward flex should occur without external application of lateral force to the arms 116 (other than the force of pushing the sliding lock radially inward). Once the apex 148 (see FIGS. 16A-16D) of the catches 136 pass the portion of sidewall 144 that is positioned radially outward of the recessed portion 142, the catch 136 enters the recessed portion 142. The tension between the arm 116 and/or catch 136 and the portion of sidewall 144 that is positioned radially outward of the recessed portion 142 is released and the arms 116 return to their extended position (see FIG. 13A). In some embodiments, an audible snap may be heard as the arms 116 return to their extended position and contact sidewall 144. The rim 125 of the sliding lock 110 may stop upon contact with the edge 65 of offset portion 111 of the flange 14. In an embodiment, the lip 124 of the sliding lock 110 may slide underneath the edge 65 of the offset portion 111 of the flange 14. The flattened portion 140 of the catch 136 may be positioned against the distal wall 146 of the recessed portion 142 and prevents reverse movement (radially outward) of the sliding lock 110. The sliding lock 110 cannot move radially outward with the catch 136 positioned within the recessed portion, against the distal wall 146. In some embodiments, the distal wall 146 is connected to a cover portion 147, which covers the catch 136 when the sliding lock 110 is in the locked position. For example, see FIGS. 13A (locked position) and 15 (shown without sliding lock 110 in position). As can be seen in 13A, the catch 136 is hidden beneath the cover portion 147 when the sliding lock 110 is locked. FIG. 24 illustrates the underside of the sliding lock 110 wherein the catch 136 is in a locked position within the cover portion 147. This feature aids in keeping the sliding lock 110 positioned against the flange. If someone or something should inadvertently bump or snag the arms 116, the cover portion 147 helps to hold the arms 116 in position and protects the arms 116 from damage.

In an embodiment (see FIGS. 16D, 22B, and 22C), the sliding lock 110 may one or more comprise stops 150 which prevent further movement of the sliding lock 110 radially inwardly, toward the center of the flange 14, by contacting the one or more stops 150 with a rib or other portion of the flange 14 or barrel 12. For example, ribs 152 (which may comprise partial ribs approximately sized to that of the flange projections 128) are shown in FIG. 15 on the flange which may contact an inner surface 156 of the stops 150 on the sliding lock 110 to prevent further inward movement of the sliding lock 110.

In another embodiment, the stops 150 may comprise hold-down feet which pass underneath the ribs 152, 154, and may secure the sliding lock 110 in position, against the flange. The channel 155 through which the stops or hold-down feet 150 pass is shown in FIG. 23. FIG. 25 illustrates a top view of the sliding lock 110 in the locked configuration. In this embodiment, the hold-down feet 150 are shown disposed under the ribs 152. FIG. 26 illustrates a top view of the sliding lock 110 in the unlocked configuration. In this embodiment, the hold-down feet 150 are shown disposed under the ribs 154. FIG. 27 illustrates the rails 134 and hold-down feet 150 disposed under the ribs 152, in a locked configuration (the top portion of the sliding lock 110 has been removed for viewability purposes). FIG. 24 illustrates the underside of the flange, with the sliding lock 110 in a locked position. As can be seen, the hold-down feet 150 are disposed in the position of the inner ribs 152. In each case (locked or unlocked configuration), the hold-down feet 150 secure the sliding lock 110 in position within the flange. It will be understood that the hold-down feet 150 (and thus the sliding lock 110 itself) can be removed from the flange when the hold-down feet 150 are positioned between the first and second set of ribs 152, 154. Removal of the sliding lock 110 is shown in FIG. 28.

In an embodiment, the stops 150 may be generally rectangular and may extend inwardly from the rails 134 toward the central body 118 of the sliding lock. However, any shape or configuration which prevents radial movement of the sliding lock 110 may be utilized.

In this position (shown in FIG. 13A), the sliding lock 110 is latched and locked in position, engaged with both the flange 14 and the barrel 12. The flange 14 cannot rotate separately from the barrel 12. The sliding lock 110 cannot be removed from the flange 14/barrel 12 without exertion of external forces. The spool 10 is secure for transportation, winding, or unwinding, or any other use known in the art. The sidewall 144 may comprise a load-bearing wall which receives torque forces during winding and unwinding processes.

To remove the sliding lock 110, in an embodiment, a user must exert pressure on at least one of the arms 116, inwardly toward the central body 118 of the sliding lock 110. This may be a compression or squeezing pressure. As the arms 116 move inwardly, the catches 136 likewise move inwardly. Once the apex 148 of each the catches 136 moves inwardly enough such that the width of the catches 136 (from one apex to the other apex) is less than the width $W_2$ of the portion of sidewall 144 that is positioned radially outward of the recessed portion 142, the catch 136 can be removed from the recessed portion 142 by sliding radially outwardly along the tracks 112, along the portion of sidewall 144 that is positioned radially outward of the recessed portion 142. The sliding lock 110 can then be slid further radially outwardly until it is disengaged from at least the barrel 12. The barrel 12 can then be separated from the flange 14, if desired.

In an embodiment, the stops 150 which prevent further movement of the sliding lock 110 toward the center of the flange 14 may also prevent further movement of the sliding lock 110 radially outwardly, away from the center of the flange, by contacting a rib or other portion of the flange 14 or barrel 12. For example, ribs 154 (which may comprise partial ribs approximately sized to that of the flange projections 128) are shown in FIG. 15 on the flange which may contact the outer surface 158 of the stops 150 on the sliding lock 110 to prevent further radially outward movement of the sliding lock 110. Thus, in this embodiment, the sliding lock 110 may be slidable only between ribs 152 and ribs 154, unless the sliding lock 110 is lifted out of the plane of the flange 14 by a user.

An alternate embodiment is shown in FIGS. 20-23. In this embodiment, the sliding lock 110 additionally comprises a retaining feature 300 disposed on the distal end 122 of the sliding lock. In this embodiment, the retaining feature 300 extends outwardly from the distal end 122, opposite the proximate end 120 and the lip 124. In an embodiment, the retaining feature 300 comprises two retaining members 310 which are biased to a first position (shown in FIG. 20) but can flex into a flexed position (not shown) to move past a post 320 in a retained position (shown in FIG. 21). The retaining members 310 may comprise elongated extensions from the distal end 122 of the sliding lock 110. The retaining members 310 may be parallel or substantially parallel to one another and perpendicular or substantially perpendicular to the distal end 122 of the sliding lock 110. The retaining members 310 may flex away from one another when passing over the post 320. The fit between the retaining members 310 and the post 320 may comprise a snap-fit. The retaining members 310 may comprise textured elements on the surfaces thereof which face each other. The retaining members 310 may comprise a bulbous end portion 330 which partially surrounds the post 320 when the retaining feature 300 is engaged with the post 320. The bulbous end portion 330 of each retaining member 310 may extend inwardly, toward the other retaining member 310, in an embodiment. The tip 340 of each retaining member 310 may have a curved or angled surface so that the respective retaining member 310 slides more easily past the post 320.

In an embodiment, the post 320 is disposed along a beam 350. In an embodiment, the beam 350 runs perpendicular or substantially perpendicular to the ribs of the flange. In an embodiment, the ribs of the flange may be characterized as beams or vice versa. In this embodiment, the beam 350 may extend between each of the retaining members 310 when the sliding lock 110 is in the unlocked position (FIG. 21). The bean 350 may provide another stabilizing feature such that the sliding lock 110 is less likely to be inadvertently removed from the flange or damaged when the sliding lock is in its unlocked position. The beam 350 and post 320 may be an integral part of the flange, in an embodiment.

In use, the retaining members 310 may allow the sliding lock 110 to be positioned in the unlocked position (see FIG. 21) but still retained on the flange. This provides a more secure positioning and lesser likelihood of loss of the sliding lock 110. The retaining feature 300 additionally ensures that when the sliding lock 110 is in the unlocked position, it is flush with and/or is disposed against the flange. This positioning prevents or reduces the likelihood that an inadvertent bump, jarring, or contact with the sliding lock 110 will cause the sliding lock 110 to become disengaged from the flange or become damaged.

When not in use, such as when the flange 14 and barrel 12 are disassembled, the sliding lock 110 may be stored within the flange 14. In an embodiment, the sliding lock 110 may be stored on the inner surface of the flange 14 or the outer surface of the flange. In an embodiment, the storage location 200 of the sliding lock 110 is different from the receiving location 105. In an embodiment, the storage location 200 of the sliding lock 110 is radially outward of the receiving location 105.

Figure 17:
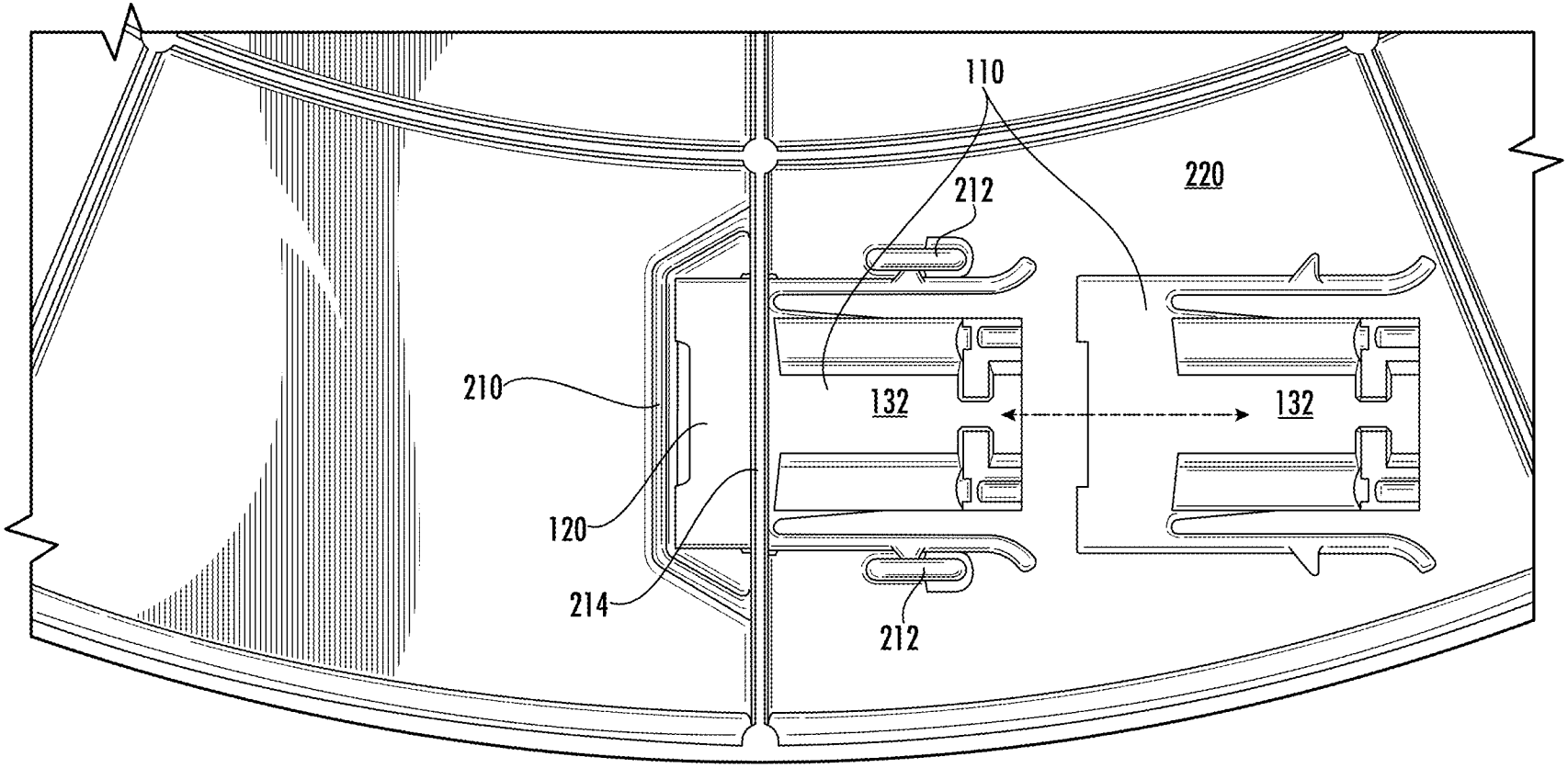
FIG. 17 shows a close-up view of a flange and stowed sliding lock in an embodiment of the invention.
Figure 18:
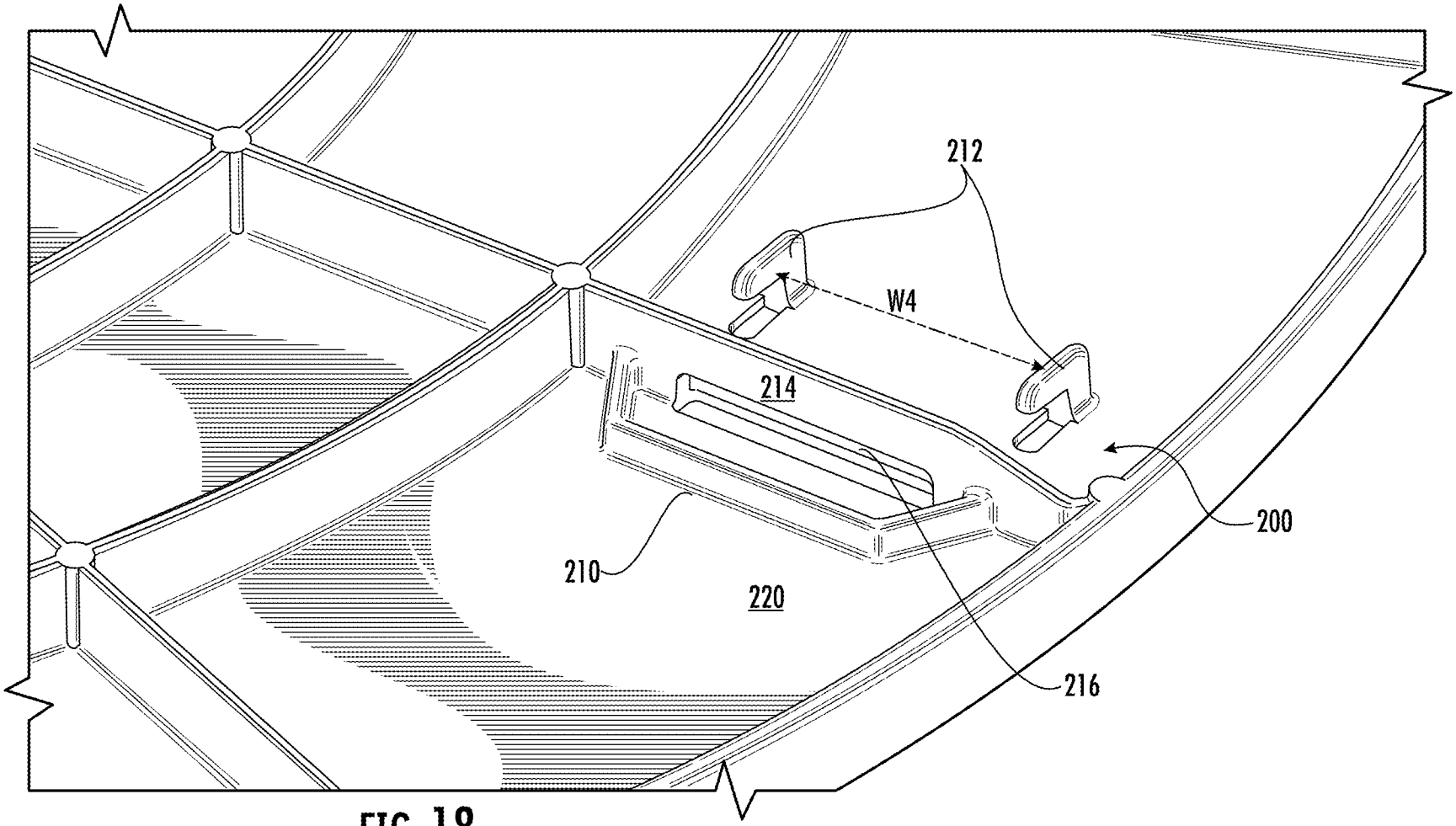
FIG. 18 shows a close-up view of a stowing location for a sliding lock on a flange, in an embodiment of the invention.
Figure 19:
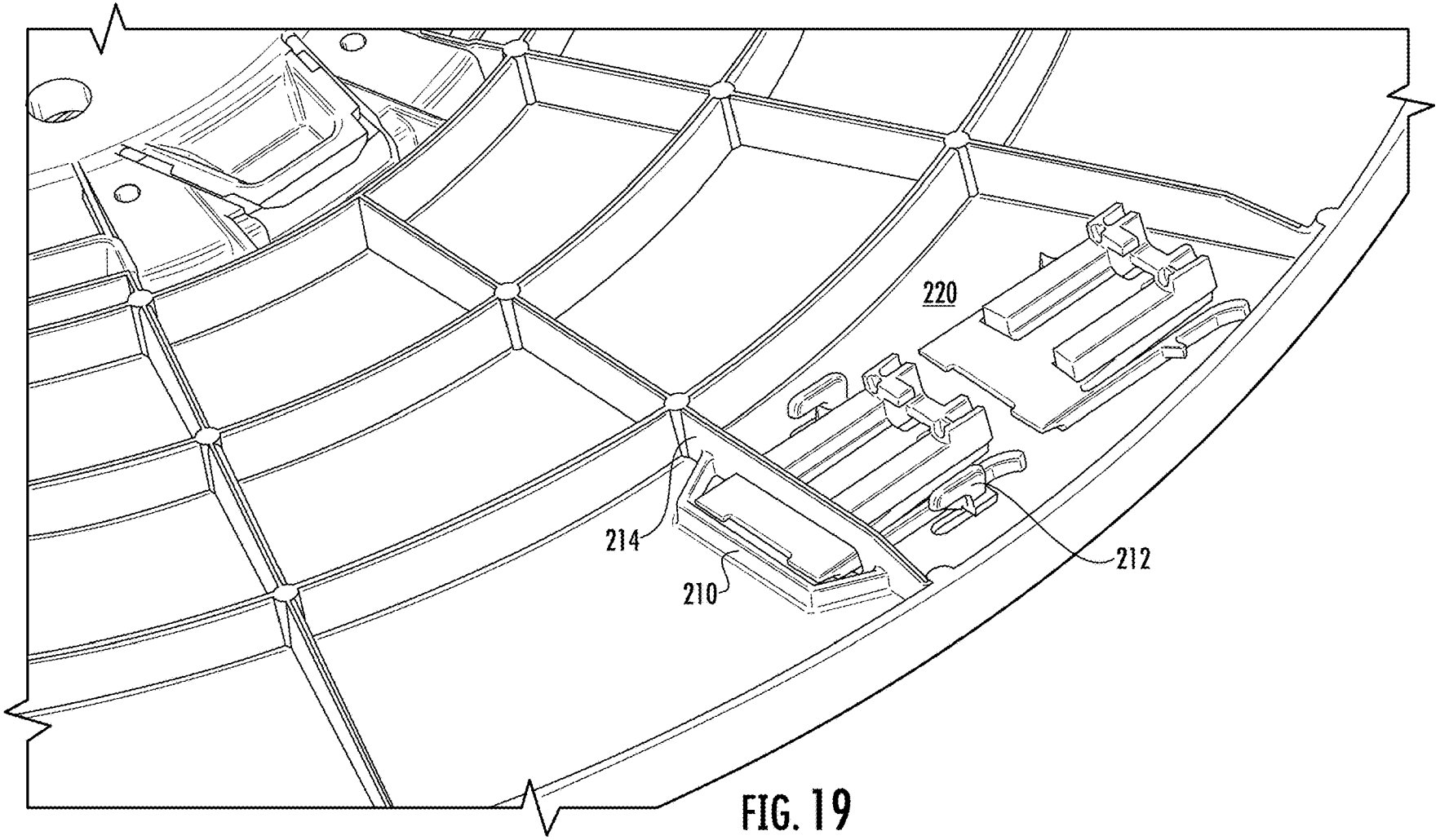
FIG. 19 shows a close-up view of a flange and stowed sliding lock in an embodiment of the invention.

FIG. 17 illustrates a sliding lock 110 in two positions, the arrow indicating movement between the positions. To insert the sliding lock 110 into its storage location 200 (see FIG. 18), a similar mechanism is used as is described above with engaging the sliding lock 110. The sliding lock 110 may be positioned as set forth in FIG. 17 and pushed toward storage base 210, illustrated by the arrows. The width $W_1$ of the arms 116 or at least the width $W_3$ of the catches 136 is greater than the width $W_4$ between each retaining hook 212. Accordingly, the arms 116 must flex inwardly to move through the space between the retaining hooks 212. The angled portion 138 of the catches 136 should allow the catches 136 to slide against the retaining hooks 212 while the arms 116 flex inwardly. Once the apex 148 of the catches 136 pass the retaining hooks 212, the catch 136 is retained by the hooks 212. The tension between the arm 116 and/or catch 136 and the retaining hooks 212 is released and the arms 116 return to their extended position. An audible snap may be heard in some embodiments. At the same time, the proximate end 120 of the sliding lock 110 passes underneath a rib 214 which helps to secure it in position and enters the area surrounded by the storage base 210.

In an embodiment, the retaining hooks 212 may comprise any shape known in the art and may comprise one or more members that extend from the flange surface 220. In an embodiment, two retaining hooks 212 are presented for each storage location. In an embodiment, the retaining hooks 212 may comprise projections that extend outwardly from the flange surface 220 (i.e. perpendicular to the flange surface 220) and turn angularly to form a hook portion that is parallel to or approximately parallel to the flange surface 220. In an embodiment, the angle between the projection and hook portion may be about 90 degrees. In an embodiment, the hook portion retains the catch 136 such that the sliding lock 110 cannot fall away from the flange surface in a direction perpendicular to the flange surface 220.

Storage base 210 may comprise any shape known in the art. In an embodiment, storage base 210 comprises one or more members that extend from the flange surface. The storage base 210 may be disposed adjunct a rib 214 which is perpendicular to the flange surface. The storage base 210 may comprise one, two, or three members in an embodiment. In an embodiment, the storage base 210 members may generally create a square, rectangular, or trapezoid shape, in connection with the rib 214. The storage base 210 may configured to approximate the shape and dimensions of the proximate end 120 of the sliding lock 110 in an embodiment. In an embodiment, the storage base 210 may be discontinuous. For example, the storage base 210 may be disposed about the corners of the proximate end 120 of the sliding lock 110 but may be discontinuous between the corners and/or between the corners and the rib 214.

As noted above, rib 214 may comprise an opening 216 through which the sliding lock 110 may be inserted. The opening 216 may be sized and configured to receive and retain the proximate end 120 of the sliding lock 110. In an embodiment, the rib 214 retains the sliding lock 110 body portion 118 such that the sliding lock 110 cannot fall away from the flange surface in a direction perpendicular to the flange surface 220. The rib 214 may comprise a bridge positioned over the sliding lock 110 when the lock 110 is engaged with the storage location 200.

The rim 125 of the sliding lock 110 may stop upon contact with the storage base 210. The flattened portion 140 of the catch 136 prevents reverse movement of the sliding lock 110 against the retaining hooks 212. In an embodiment, the inner surface 132 of the sliding lock 110 is positioned outwardly in the storage location 200, such that the rails 134 are visible when the sliding lock 110 is in its storage position. In other embodiments, the outer surface 130 of the sliding lock may be viewable when the sliding lock 110 is in its storage location (i.e. the sliding lock 110 may be inserted such that the outer surface 130 of the sliding lock 110 is positioned outwardly).

To remove the sliding lock 110 from its storage location 200, in an embodiment, a user must exert pressure on at least one of the arms 116, inwardly toward the central body 118 of the sliding lock 110. This may be a compression or squeezing pressure. As the arms 116 move inwardly, the catches 136 likewise move inwardly. Once the apex 148 of each the catches 136 moves inwardly enough such that the width of the catches 136 (from one apex to the other apex) is less than the width $W_4$ between the retaining hooks 212, the catch 136 can be slid outwardly. The sliding lock 110 can then be slid further radially outwardly until it is disengaged from the storage base 210 and can be removed. The sliding lock 110 can then be used as described above. See FIG. 30 for an alternate embodiment of the storage location for the sliding lock 110. The embodiment set forth in FIG. 30 illustrates the storage of the sliding lock 110 embodiment which has an elongated lip and retaining feature 300.

If a sliding lock 110 is damaged or destroyed, it may be removed from the spool 10 and replaced by another sliding lock 110. The flange 14 and the barrel 12 may be reused. In an embodiment, a plurality of replacement sliding locks 110 may be stowed within a single flange 14. In an embodiment, the sliding lock 110 as described herein is surprisingly strong and can withstand high loads typically imparted on spool assemblies.

It is preferred that the structures of the present invention be formed with a minimum number of parts. Thus, in an embodiment, the completed spool may have a single barrel part, two flange parts, and a sliding lock. The spool parts are also contemplated to be injection molded from a thermoplastic material, such as styrene, an olefin or combination of polymer materials. Further, the structures of the barrel are preferably integrally molded. Each flange part is also integrally molded. The surfaces and structural elements of the molded parts are preferably arranged to allow for withdraw of the mold sections from the parts with a minimum of movements and mold sections.

The present invention has been described and illustrated with respect to a number of exemplary embodiments thereof. It should be understood by those skilled in the art from the foregoing that various other changes, omissions and additions may be made therein, without departing from the spirit and scope of the present invention, with the scope of the present invention being described by the foregoing claims.

What is claimed is:

1. A spool locking system comprising:

a barrel comprising a first longitudinal end and a second longitudinal end, wherein at least the first longitudinal end comprises at least one barrel detent;

a first flange removably affixable to the first longitudinal end of the barrel, wherein the first flange comprises at least one receiving location for a sliding lock, the receiving location comprising:

at least one flange detent, wherein the at least one flange detent is aligned with the at least one barrel detent; and at least one sidewall having at least one recessed portion; and the sliding lock comprising:

a body portion comprising a proximate end, a distal end, two sides, an outer surface and an inner surface;

at least one rail disposed on the inner surface of the body portion, wherein the at least one rail is configured to engage with the at least one flange detent and the at least one barrel detent, and wherein at least one sidewall of the at least one barrel detent is angled to direct the at least one rail into the correct alignment with the at least one barrel detent;

at least one flexible arm affixed to the body portion; and at least one catch disposed on the at least one arm, wherein the catch is configured to engage with the at least one recessed portion of the flange receiving location and, once engaged with the at least one recessed portion of the flange receiving location, restricts disengagement with the at least one recessed portion.

2. The spool locking system of claim 1, wherein the spool is an industrial spool.

3. The spool locking system of claim 1 additionally comprising a second flange removably affixable to the second longitudinal end of the barrel.

4. The spool locking system of claim 1 comprising two flange detents aligned with two barrel detents.

5. The spool locking system of claim 4 comprising at least two rails disposed on the inner surface of the body portion.

6. The spool locking system of claim 1, wherein the proximate end of the sliding lock body portion is radially inward on the flange of the distal end of the sliding lock body portion.

7. The spool locking system of claim 1, wherein the at least one rail initiates near the proximate end of the body portion, extends along the length of the body portion, and terminates near the distal end of the body portion.

8. The spool locking system of claim 1, wherein the at least one arm is biased toward an initial position and compressible by applying pressure to the arm.

9. The spool locking system of claim 1, comprising a first arm having a first catch, a second arm having a second catch, a first sidewall of the receiving location comprising a first recessed portion, and a second sidewall of the receiving location comprising a second recessed portion.

10. The spool locking system of claim 8, wherein a width from an apex of first catch to an apex of the second catch is greater than the distance between the first sidewall and the second sidewall, in a location radially outward of the recessed portion.

11. The spool locking system of claim 1 comprising a first locked position wherein the at least one rail is positioned in the at least one flange detent and at least one barrel detent and the at least one catch is positioned within the at least one recessed portion; and a second unlocked position wherein the at least one rail is not positioned within the at least one barrel detent and the catch is not positioned within the recessed portion.

12. The spool locking system of claim 11, wherein in the second unlocked position, the at least one rail is positioned within the at least one flange detent.

13. The spool locking system of claim 1, wherein a retaining portion extends from the distal end of the sliding lock, opposite the proximate end, wherein the retaining portion is configured to snap-fit onto a portion of a rib of the flange.

14. The spool locking system of claim 1, wherein a lip extends from the proximate end of the sliding lock, opposite the distal end, wherein the lip is configured to engage with the flange within the receiving location.

15. The spool locking system of claim 14 wherein the lip is configured to engage with an edge of an offset portion of the flange.

16. The spool locking system of claim 15 wherein the lip is configured to slide under the edge of the offset portion of the flange.

17. The spool locking system of claim 14, wherein upon disengagement, the at least one rail is positioned within the at least one flange detent.

18. A method for locking a spool comprising:

providing a barrel comprising a first longitudinal end and a second longitudinal end, wherein at least the first longitudinal end comprises at least one barrel detent;

providing a first flange comprising at least one receiving location for a sliding lock, the receiving location comprising at least one flange detent and at least one sidewall having at least one recessed portion;

removably affixing the first flange to the first longitudinal end of the barrel;

aligning the at least one barrel detent with the at least one flange detent;

providing the sliding lock comprising:

a body portion comprising a proximate end, a distal end, two sides, an outer surface and an inner surface;

at least one rail disposed on the inner surface of the body portion;

at least one flexible arm integral with the body portion; and at least one catch disposed on the at least one arm;

engaging the at least one rail with the at least one flange detent and the at least one barrel detent; and engaging the at least one catch with the at least one recessed portion.

19. A method for unlocking a spool comprising:

providing a barrel comprising a first longitudinal end and a second longitudinal end, wherein at least the first longitudinal end comprises at least one barrel detent;

providing a first flange comprising at least one receiving location for a sliding lock, the receiving location comprising at least one flange detent and at least one sidewall having at least one recessed portion;

removably affixing the first flange to the first longitudinal end of the barrel;

aligning the at least one barrel detent with the at least one flange detent;

providing the sliding lock comprising:

a body portion comprising a proximate end, a distal end, two sides, an outer surface and an inner surface;

at least one rail disposed on the inner surface of the body portion;

at least one flexible arm integral with the body portion; and at least one catch disposed on the at least one arm;

providing the at least one rail within the at least one flange detent and the at least one barrel detent;

providing the at least one catch within the at least one recessed portion; and disengaging the catch from the recessed portion and the at least one rail from the at least one barrel detent.

* * * * *